US009114912B2

(12) United States Patent
Giovannini et al.

(10) Patent No.: US 9,114,912 B2
(45) Date of Patent: Aug. 25, 2015

(54) TAMPER EVIDENT CLOSURE

(75) Inventors: Marco Giovannini, Milan (IT); Luca Viale, Alessandria (IT)

(73) Assignee: Guala Closures S.P.A., Alessandria (IT)

( * ) Notice: Subject to any disclaimer, the term of this patent is extended or adjusted under 35 U.S.C. 154(b) by 166 days.

(21) Appl. No.: 13/519,250

(22) PCT Filed: Nov. 19, 2010

(86) PCT No.: PCT/IB2010/002959

§ 371 (c)(1),
(2), (4) Date: Jul. 25, 2012

(87) PCT Pub. No.: WO2011/086407

PCT Pub. Date: Jul. 21, 2011

(65) Prior Publication Data

US 2012/0279940 A1 Nov. 8, 2012

(30) Foreign Application Priority Data

Jan. 15, 2010 (WO) ..... PCT/IT2010/000009

(51) Int. Cl.
*B65D 39/00* (2006.01)
*B65D 39/16* (2006.01)
*B65D 55/02* (2006.01)

(52) U.S. Cl.
CPC ..... *B65D 39/0052* (2013.01); *B65D 39/16* (2013.01); *B65D 55/026* (2013.01)

(58) Field of Classification Search
CPC ..... B65D 39/00; B65D 39/12; B65D 39/14; B65D 39/0052; B65D 39/0064; B65D 39/0076
USPC ..... 215/329, 358, 359, 360, 361, 364, 308, 215/295, 296, 299, 279, 246, 253, 254; 220/234, 235, 236, 237, 238
See application file for complete search history.

(56) References Cited

U.S. PATENT DOCUMENTS

| | | | | | |
|---|---|---|---|---|---|
| 869,700 | A | * | 10/1907 | Fraser | 215/360 |
| 2,718,974 | A | * | 9/1955 | Helbig | 215/360 |
| 2,940,629 | A | * | 6/1960 | Cros | 215/359 |
| 3,091,358 | A | * | 5/1963 | Simpkins | 220/238 |
| 3,430,777 | A | * | 3/1969 | Esposito, Jr. | 215/256 |

(Continued)

FOREIGN PATENT DOCUMENTS

| | | |
|---|---|---|
| DE | 1 157 101 | 11/1963 |
| EP | 2 028 121 | 2/2009 |

(Continued)

OTHER PUBLICATIONS

Creative GCL S.R.L., International Search Report for PCT/IB2010/002959, dated Jul. 4, 2011, 10 pages.

*Primary Examiner* — Anthony Stashick
*Assistant Examiner* — Ernesto Grano
(74) *Attorney, Agent, or Firm* — King & Spalding

(57) ABSTRACT

The present invention relates to a tamper evident closure in which the outer portion (10) rises upon first opening, and having means that prevent such outer portion from falling back to the original position once it has risen. Therefore, the tamper evident effect is given by the misalignment of the outer portion and the central portion (8). The closure may be made of cork, possibly of synthetic nature, or of screw type, adapted to be tightened to a threaded pouring device applied to the neck of the bottle.

15 Claims, 25 Drawing Sheets

(56) References Cited

U.S. PATENT DOCUMENTS

| | | | | |
|---|---|---|---|---|
| 3,638,821 | A * | 2/1972 | Guala | 215/253 |
| 4,621,743 | A * | 11/1986 | DiRegolo et al. | 215/308 |
| 4,674,641 | A | 6/1987 | Rusinyak | |
| 4,902,270 | A * | 2/1990 | Comeau et al. | 494/16 |
| 5,117,995 | A * | 6/1992 | Kau | 215/228 |
| 5,722,548 | A * | 3/1998 | Hojnoski | 215/299 |
| 5,732,837 | A * | 3/1998 | Jones | 215/311 |
| 6,168,036 | B1 * | 1/2001 | Teng | 215/296 |
| 6,536,618 | B1 * | 3/2003 | Hwang et al. | 215/358 |
| 6,651,834 | B2 * | 11/2003 | Wong | 215/260 |
| 6,719,160 | B2 * | 4/2004 | Sen-Yih | 215/361 |
| 6,769,560 | B1 * | 8/2004 | Lin | 215/361 |
| 6,915,920 | B2 * | 7/2005 | Hwang et al. | 215/358 |
| 7,276,202 | B2 * | 10/2007 | Choi | 264/610 |
| 7,731,043 | B2 * | 6/2010 | Wang Wu | 215/355 |
| 2005/0127155 | A1 | 6/2005 | Claessens et al. | |
| 2008/0116165 | A1 * | 5/2008 | Lin | 215/294 |

FOREIGN PATENT DOCUMENTS

| | | |
|---|---|---|
| FR | 2 688 762 | 9/1993 |
| WO | WO 02/083515 | 10/2002 |

* cited by examiner

TAMPER EVIDENT CLOSURE

TECHNICAL FIELD

The present invention relates to a tamper evident closure, i.e. a closure comprising devices that can provide evidence of first opening.

BACKGROUND OF THE INVENTION

The discussion of documents, deeds, materials, devices, papers and the like is only incorporated in this specification to provide some context for the present invention. These materials shall not be deemed or intended to be wholly or partially part of the prior art, or to be of general knowledge in the field of the present invention, as existing before the priority date of any claim of this application.

WO03/066467, for instance, discloses a closure assembly for pharmaceutical applications which has both tamper evident and child proof features: the tamper evident feature is provided by a first portion of the outer surface of the closure assembly, which creates a step with respect to a second portion of the same outer surface, whereas the child proof feature is provided by forcing the user to an opening movement that shall necessarily involve two distinct directions. This closure assembly has the undoubted drawback of simple opening, which is inherently disadvantageous in the pharmaceutical field, that requires child proof closure assemblies.

WO2005/021400, by Guala Closures S.p.A. discloses a tamper evident closure assembly that is opened by a movement that shall not necessarily involve two distinct directions (hence defining a non child proof closure), in which an internal element is broken and moved to expose a surface underneath it, to show that first opening has occurred. The main drawback of this closure assembly consists in the need for internal breakable elements as well as a relatively complex system for breaking them.

EP1511677B1, granted to Guala Closures UK Limited discloses a tamper evident closure assembly, in which the opening movement exposes a counteracting annular element, the closure of the closure element being unable to be restored to the starting position after first opening. Nevertheless, the simple construction of the structure of this closure unit is a limit to tamper evident features, which necessarily rely on the size of the annular element to be exposed during first opening.

The above discussion of the prior art shows that there is still a need for a closure assembly that can combine both features of simple construction and effectiveness of the above described tamper evident systems.

In view of the above prior art, the object of the present invention is to at least partially fulfill the above need, while at least partially obviating prior art drawbacks.

Furthermore, the present invention provides a closure assembly having advantages in terms of simple fabrication, greater strength, more compact design and/or higher versatility.

SUMMARY OF THE INVENTION

According to the present invention, this purpose is fulfilled by a tamper evident closure for closing the mouth of a container, said closure extending substantially along a longitudinal axis and comprising an outer gripping surface and an inner member (or inner portion) which are movable relative to each other between a first configuration, corresponding to the configuration prior to first opening, and a second configuration, corresponding to the configuration after first opening; said inner member comprising first reversible attachment means, capable of attaching said inner member to said container while normally opening and closing the container and second irreversible attachment means capable of maintaining or locking said closure in said second configuration; wherein the external appearance of said closure in said second configuration is different from the external appearance of said closure in said first configuration.

BRIEF DESCRIPTION OF THE DRAWINGS

The characteristics and advantages of the present invention will appear from the following detailed description of one practical embodiment, which is given as a non limiting example with reference to the annexed drawings, in which:

FIGS. 4*a*-4*d* show views like those of FIGS. 1*a*-1*d*, of a closure according to a fourth embodiment of the present invention;

FIGS. 5*a*-5*c* show sequentially partially sectional side views of a closure according to a fifth preferred embodiment of the present invention, applied to a bottle neck in the following configurations: closed prior to first opening, during first opening, open after first opening, reclosed after first opening respectively;

FIG. 6*a* is a sectional view of a closure according to a sixth preferred embodiment of the present invention, applied to a bottle neck in the closed configuration prior to first opening;

DETAILED DESCRIPTION

Figure 1A:
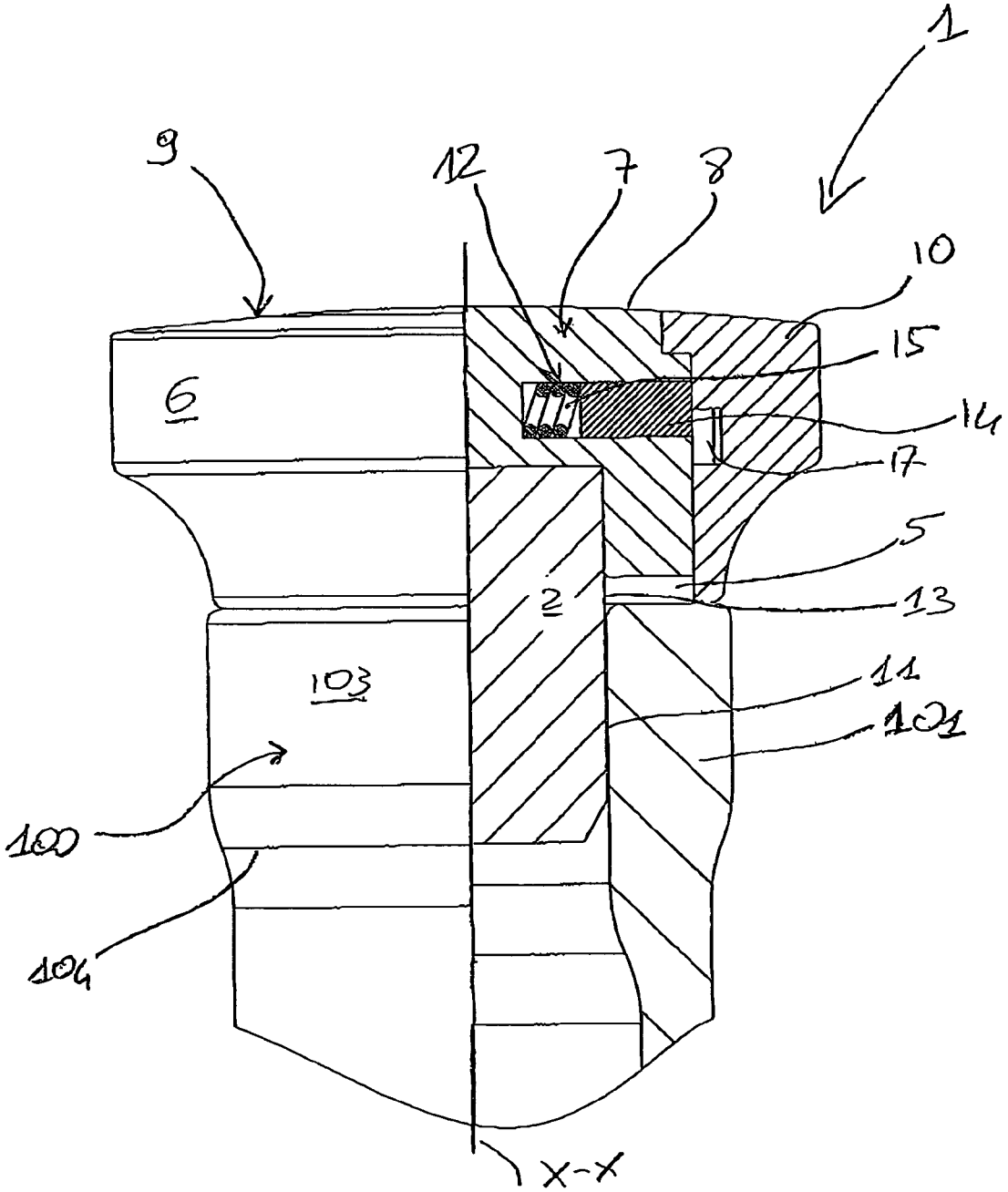
FIGS. 1*a*-1*c* shows sequentially partially sectional side views of a closure according to a preferred embodiment of the present invention, applied to a bottle neck in the following configurations: closed prior to first opening, open after first opening, reclosed after first opening respectively.
Figure 1B:
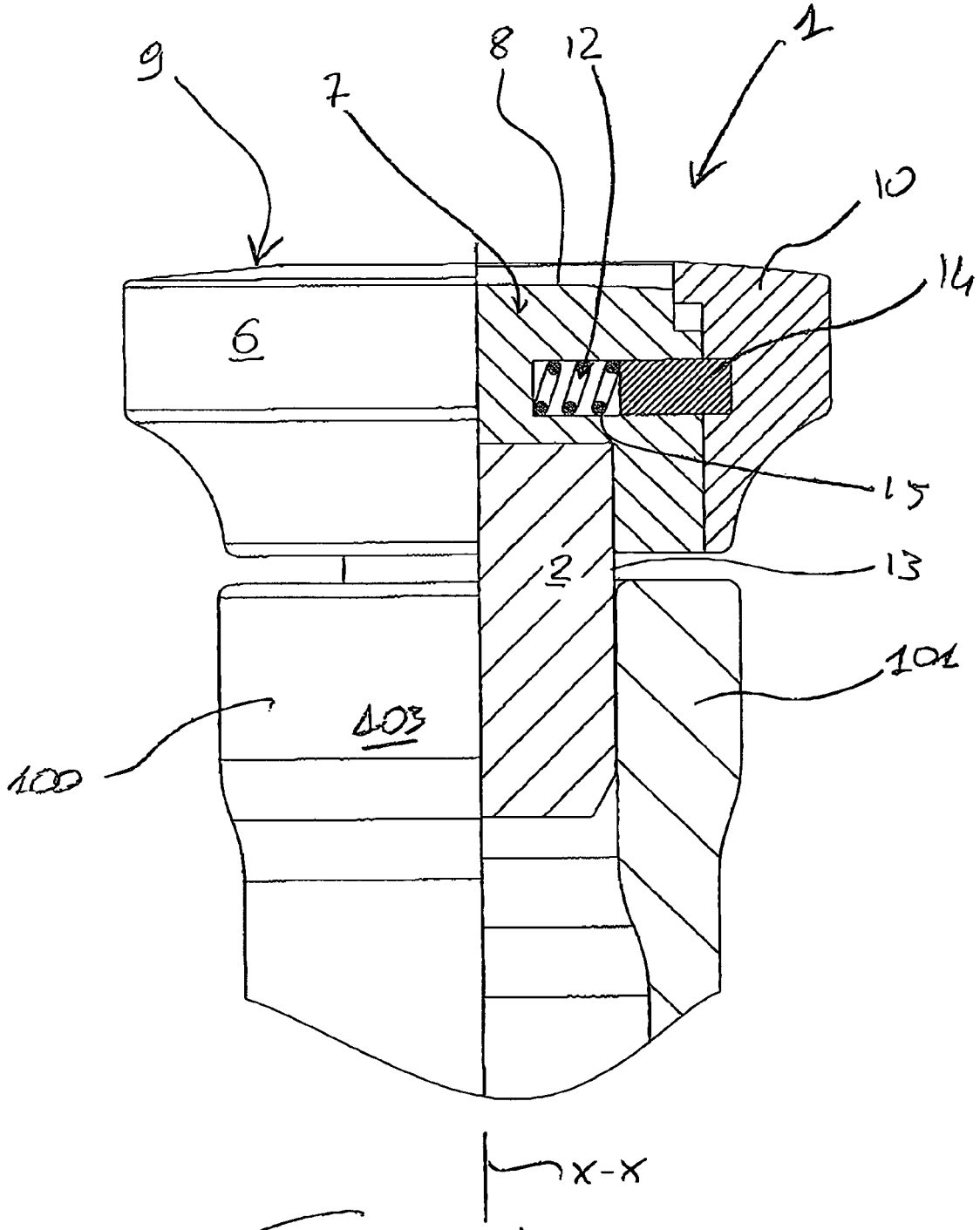
Figure 1C:
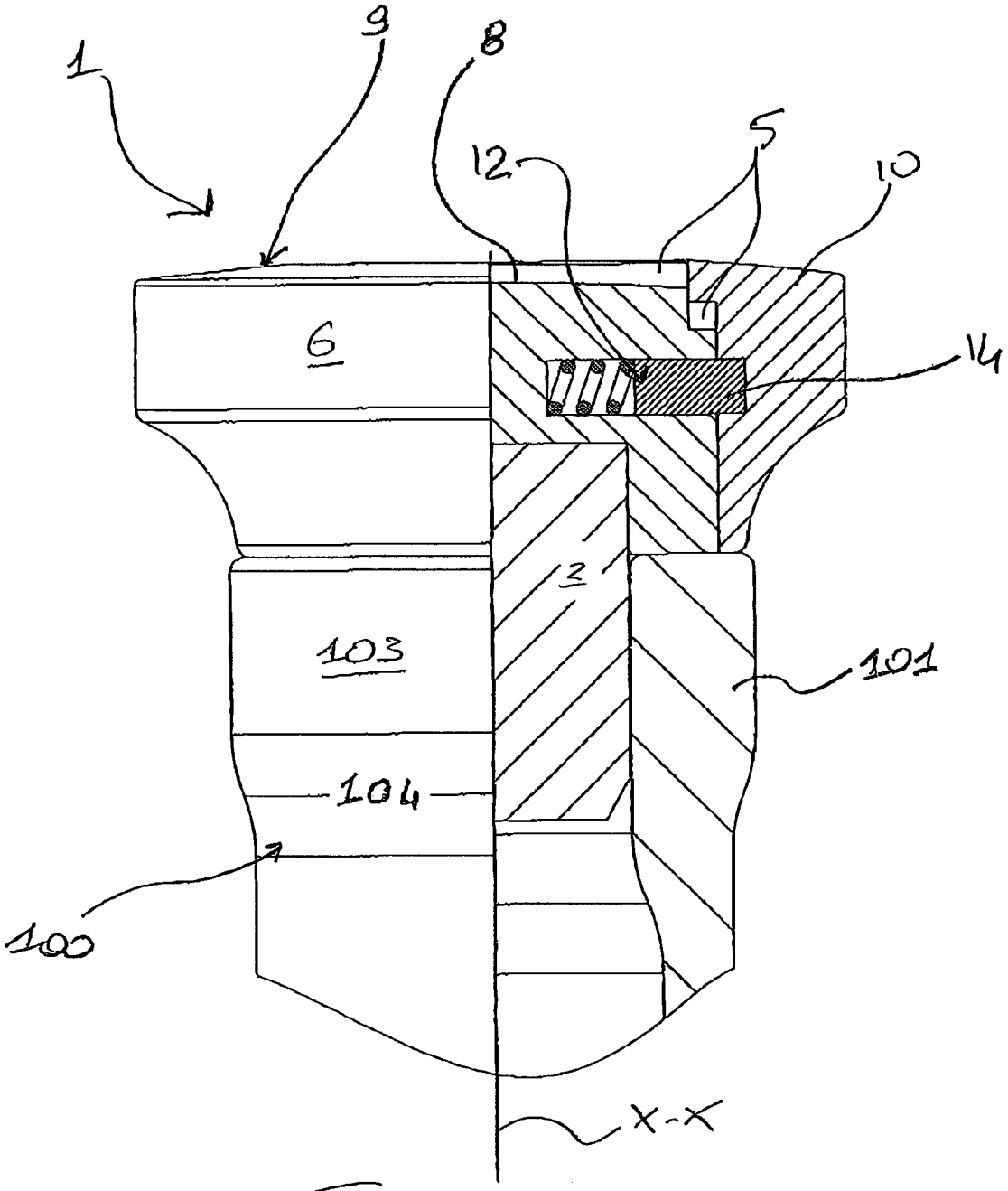
Figure 1D:
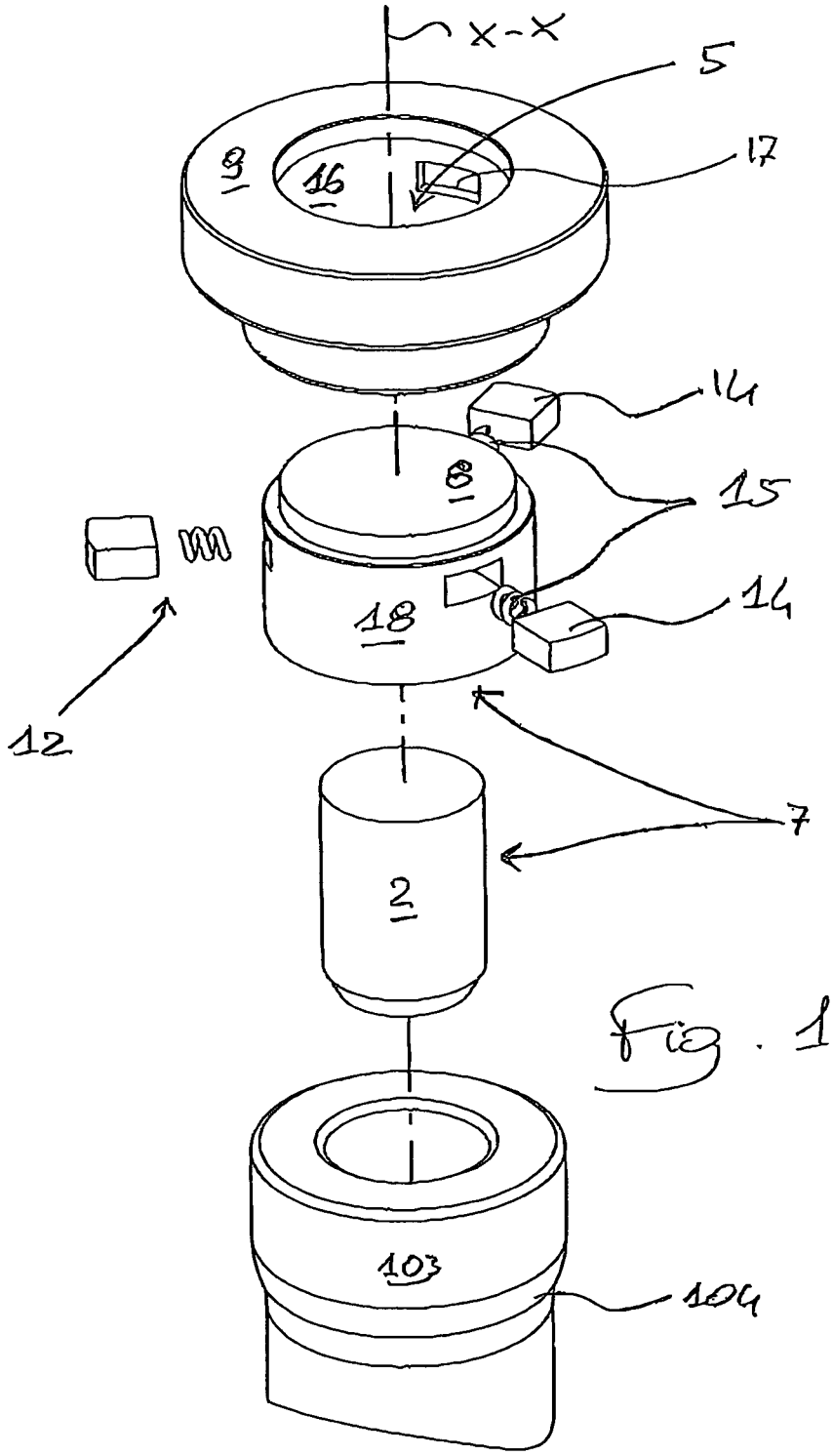
FIG. 1*d* shows an exploded perspective view of the closure of FIGS. 1*a*-1*c;*

As used in the description and claims of the present specification, the terms "comprises", and its variants, such as "comprising", are not intended to exclude any other additional elements, parts or components, and any other steps or stages.

FIGS. 1*a*-4*d* show an unthreaded closure, generally designated by numeral 1. Such closure 1 is typically a stopper, i.e. comprising a cylindrical inner member 2 having such shape and size as to allow sealable engagement with the interior of the neck 101 of a container 100.

The inner member 2 is traditionally made of cork, although alternative solutions have been recently suggested to form such members of a synthetic material known as "synthetic cork". One of these materials is disclosed, for instance, in patent application EP1423310.

The shape, size and material of an inner member 2 of the stopper type may fall in a relatively limited range as may be readily recognized by those skilled in the art, but also by ordinary users.

For the purposes of the present description, by way of illustration and without limitation, the term inner member 2 will be used to designate a stopper as mentioned above, which has a substantially cylindrical shape and is capable of ensuring the desired liquid-tightness in the neck 101 of the container 100. Such stopper may be made of cork, synthetic cork or other materials, such as a hollow PE stopper with sealing threads such as the ones for sparkling wine. Through the variety of shapes and materials, those of ordinary skill in the art will be anyway able to recognize an inner member 2 corresponding or equivalent to the one as described and/or claimed herein.

However, in FIGS. 5*a*-6*e*, the closure 1 comprises internal threads 3 for engagement with external threads 106 integral with the container 100. In the examples, the container 100 is not threaded in itself, but a lower element 4 is attached thereto, which comprises a pouring device fastened and fixed to the neck 101 of the container 100.

The container 100 is advantageously a bottle, and comprises a neck 101 that terminates in a mouth. The neck 101 may comprise an outer projection 103, delimited by a bottom surface 104 and a top surface 105.

While the closure 1 in itself may be oriented in any direction, for the purposes of the present direction the vertical axis will be defined as the longitudinal axis X-X of the closure 1 and conventionally the bottom side will be the side of the closure 1 designed to face towards the container 100, and the top side will be the one designed to face towards the consumer; this is actually the normal orientation of the closure when fitted onto a normally oriented bottle (as shown in the figures).

Still referring to the figures, the closure 1 comprises an outer gripping surface 6 and an inner portion 7, which are movable relative to each other between first and second configurations. The outer gripping surface 6 corresponds to that part of the closure 1 that can be grasped by a user for opening and closing the closure 1 itself. Typically, it coincides with the outer surface of the closure 1 and has a cylindrical shape (or at least a cylindrical symmetry).

The inner portion 7 is movable relative to the surface 6 between a first configuration, corresponding to the configuration prior to first opening (as shown in FIGS. 1*a*, 2*a*, 3*a*, 4*a*, 5*a*, 6*a*) and a second configuration, corresponding to the configuration after first opening (as shown in FIGS. 1*c*, 2*c*, 3*c*, 4*c*, 5*c*, 6*c*).

In the second configuration, a few characteristics are shown which evidence that first opening has occurred.

In other words, in the closure 1 the inner portion 7 moves down relative to the surface 6 (or: the surface 6 moves up relative to the inner portion 7) during first opening, and the closure 1 comprises means for preventing such inner portion 7 from rising again after its descent (or; for preventing the outer surface 6 from descending after rising).

When the container 100 is taken as a fixed reference, then during first opening, the inner portion 7 initially remains axially stationary with respect to the container 100, whereas the gripping surface 6 moves axially upwards.

The container 100 will not always be taken as a fixed reference in the description and claims hereinbelow, and the gripping surface 6 may be also taken as a reference. In the latter case, the inner portion 7 will be lowered relative to the gripping surface 6. This difference obviously concerns the viewpoint only and will in no way affect the validity of the technical solution and its operation.

Advantageously, in the second configuration, the inner portion 7 is lowered relative to the gripping surface 6.

Conveniently, in the second configuration, a part 8 of the top surface 9 of the closure 1 may be lowered relative to the remaining part 10*m* of the top surface 9. The part 8 that moves down may be a central disk, a ring concentric with the axis X-X, or may have any other shape (e.g. a polygonal shape, or the logo of the manufacturer of the liquid in the container 100).

The central part 8 is advantageously contained in (or coincident with, if it has a circular shape) a circle having a diameter from 25% to 75% of the diameter of the rest of the top surface 10*m*, preferably from 40% to 60% of such diameter. Conveniently, the diameter of such circle may also be smaller than the diameter of the neck 101 of the container 100.

The top surface 9 of the closure 1 is formed on an outer portion (or outer member) 10, in which at least part of the inner portion 7 is held.

The outer portion 10 comprises a seat 5, whose shape, excepting any seats for permanent attachment means (see below), may be substantially cylindrical or composed of concentric cylinders. Alternatively, the shape of the seat 5 may be composed of one or more solids having a triangular, square, rectangular, hexagonal shape or possibly with a larger number of sides.

Figure 6D:
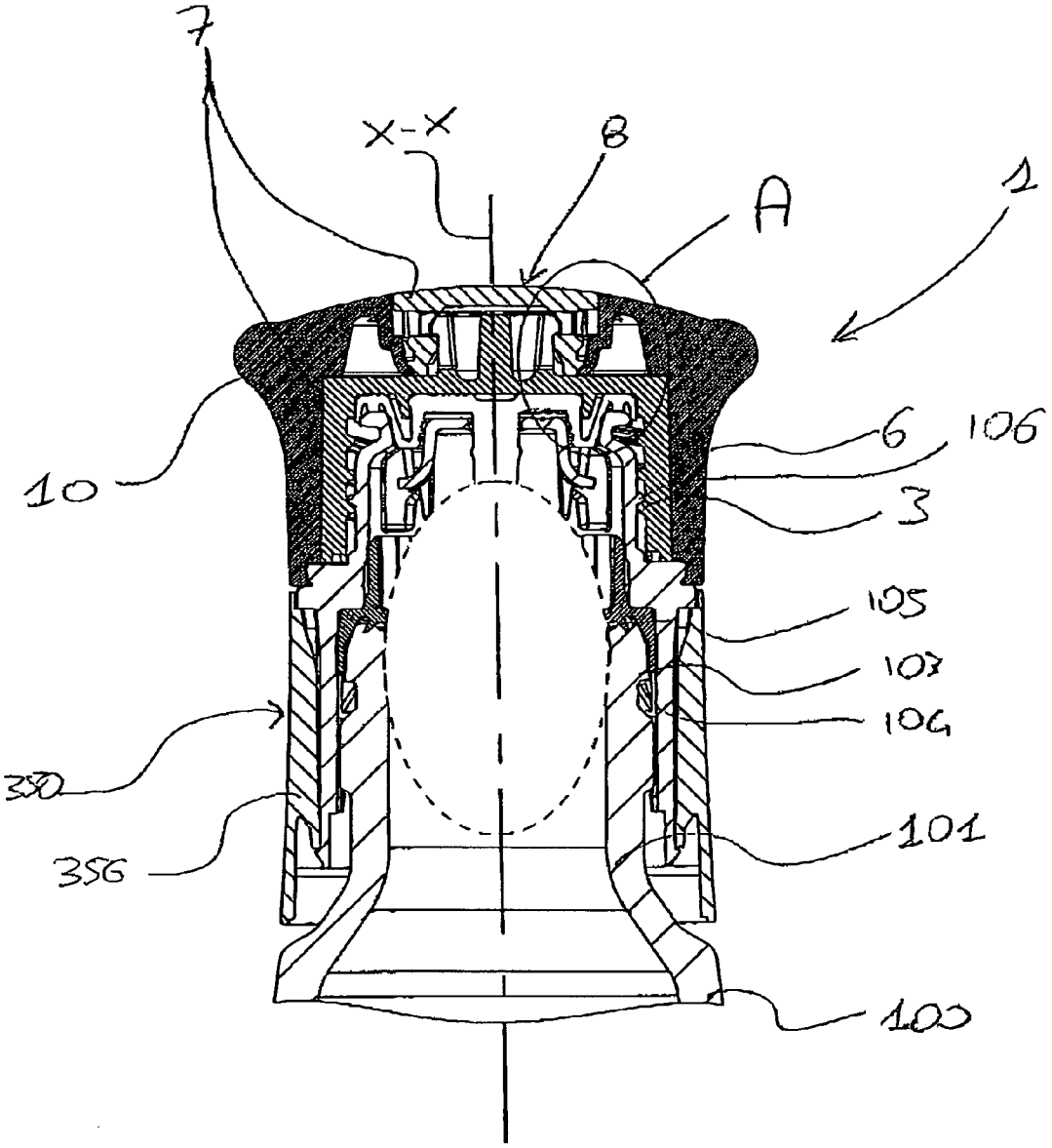
FIGS. 6*d*-6*e* are top and bottom exploded perspective views of the closure of FIG. 6*a* respectively.
Figure 6B:
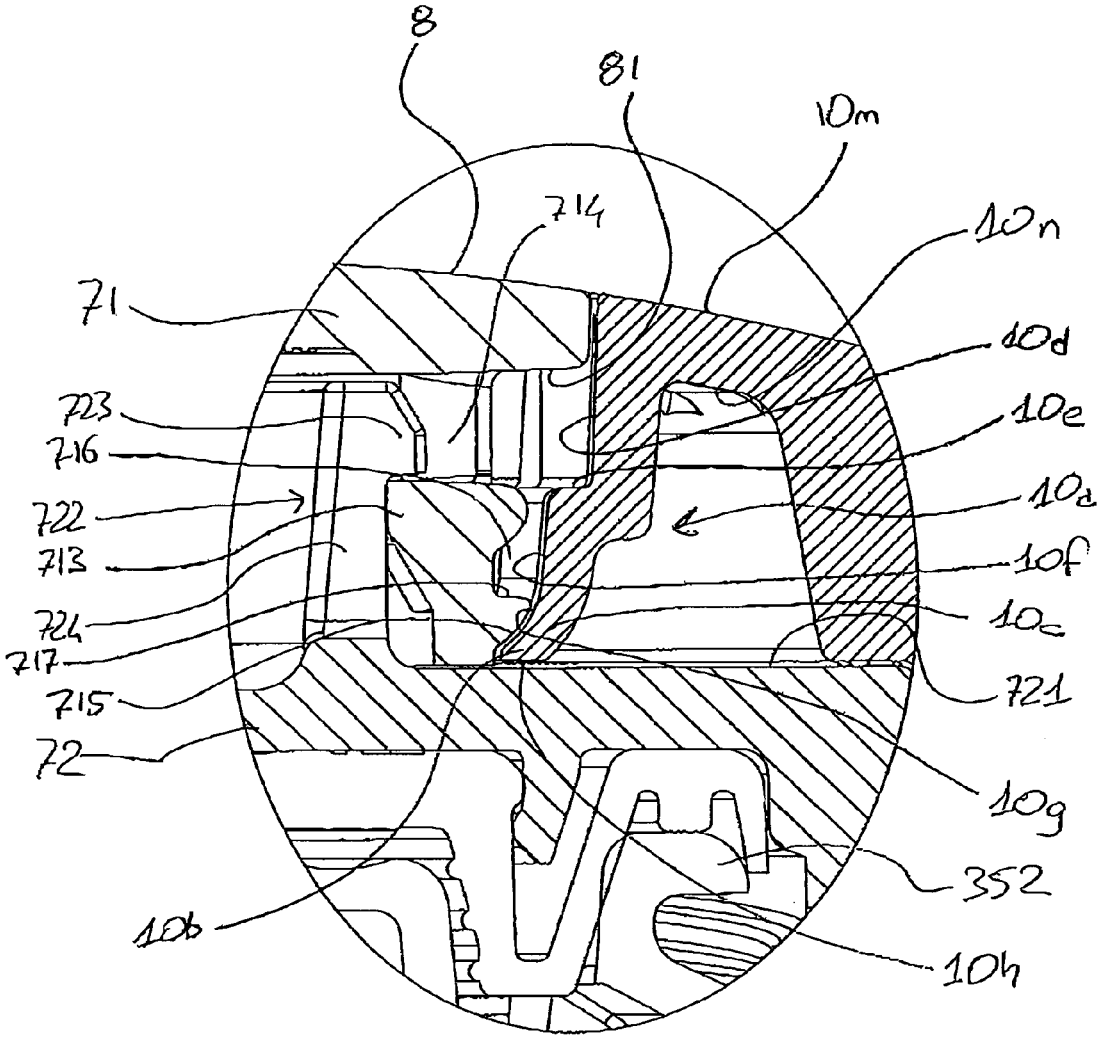
FIG. 6*b* shows the detail, referenced A, of the closure of FIG. 6*a;*
Figure 6C:
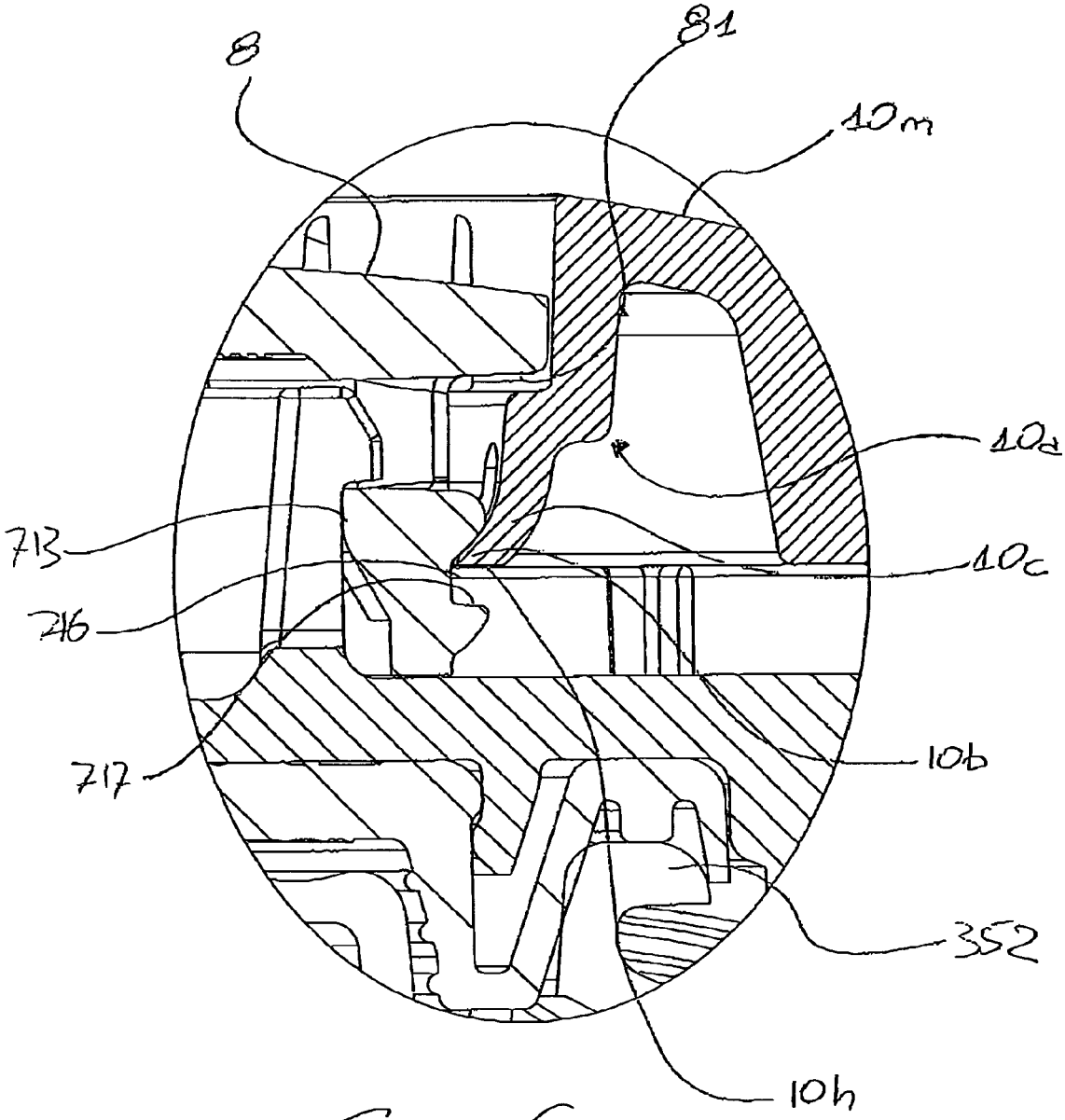
FIG. 6*c* shows the detail of the closure of FIG. 6*b* in the configuration after first opening.
Figure 6D:
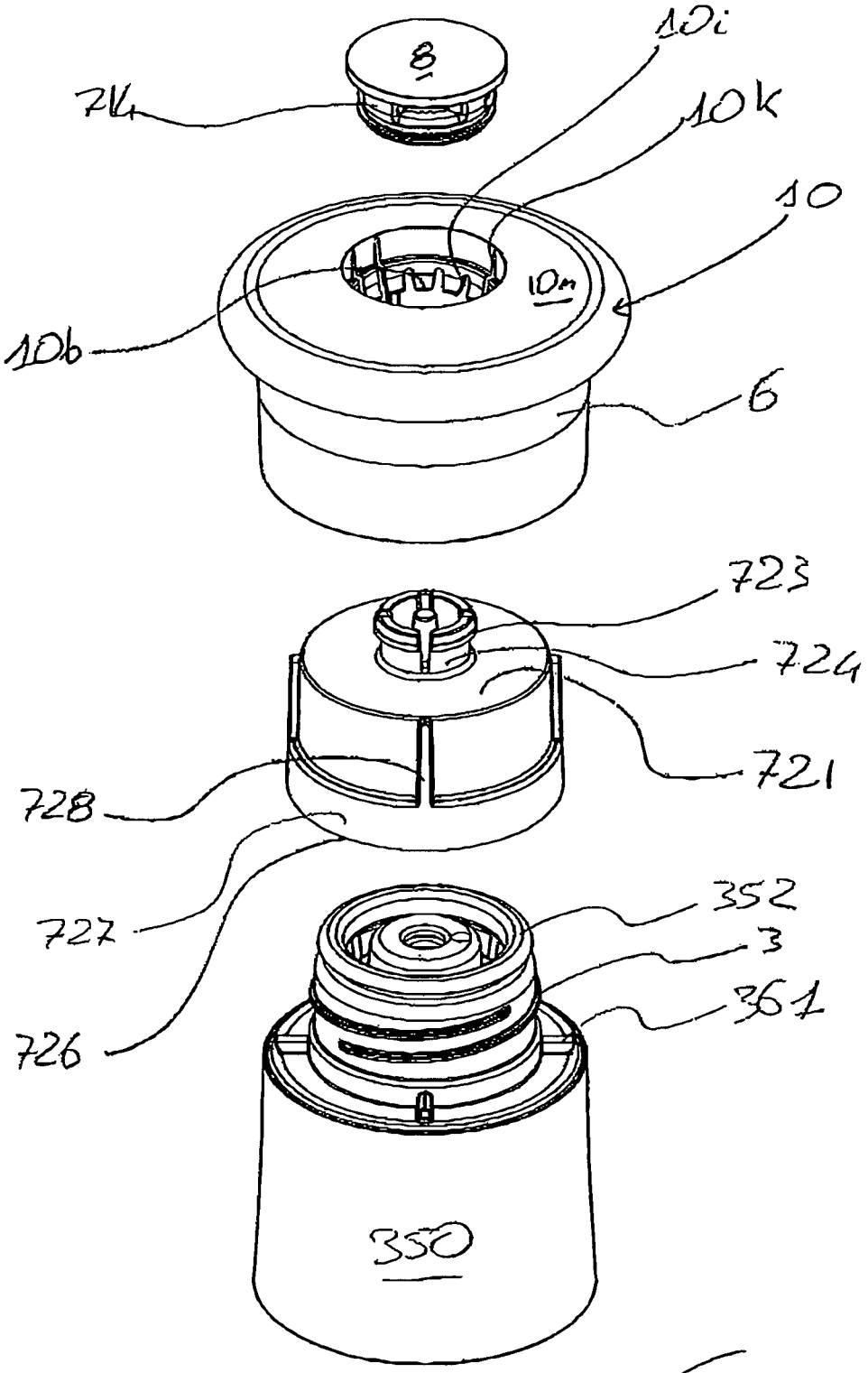
Figure 6E:
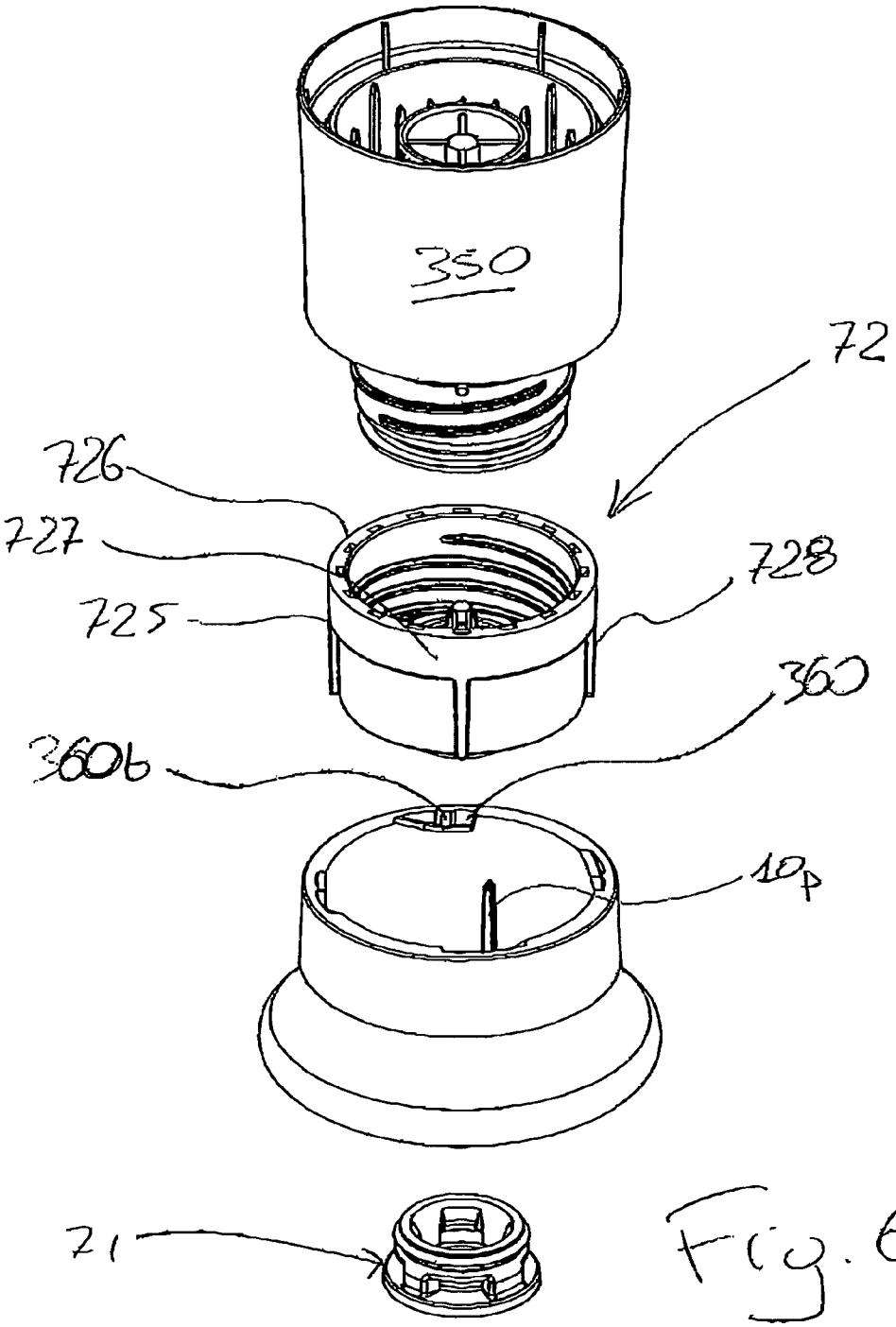

In FIGS. 6*b* and 6*e*, the seat 5 is shown to have a substantially cylindrical shape, or to be composed of concentric cylinders, with the exception of ribs 728 and 10*p*, which are used to prevent relative rotation between the inner portion 7 and the outer portion 10.

As shown in the figures, the larger diameter of the seat 5 is on the bottom side, and the smaller diameter is on the top side. Thus, the outer portion 10 comprises means that prevent any upward motion of the inner portion 7; nevertheless, the inner portion 7 may move downwards within the seat 5, preferably during first opening, for instance only during first opening.

The relative motion between the inner portion 7 and the outer portion 10 (and hence the gripping surface 6) may be a translational or roto-translational motion.

Advantageously, the inner portion 7 remains intact during the motion between the first and second configurations; in other words, the inner portion 7 does not require the rupture of bridges or weakened lines, to accomplish its tamper evident task.

The inner portion 7 comprises first and second attachment means 11, 12, which allows it to be attached to the container 100 and the outer portion 10 respectively.

The first attachment means 11 are reversible, i.e. can attach the inner portion 7 to the container 100 a number of times without any substantial change. In the embodiment as shown in FIGS. 1*a*-4*d*, the first attachment means 11 consist of the outer surface 13 of the cork 2, which has such surface characteristics as to allow reversible engagement thereof with the interior of the neck 101 of the container 100. Conversely, in the embodiment of FIGS. 5*a*-6*a*, the first attachment means 11 consist of the internal threads 3.

These reversible attachment means 11 are those that are used while normally opening and closing the container 100.

Conversely, the second attachment means 12 are irreversible and capable of maintaining or locking the inner portion 7 in the second configuration.

In short, the second attachment means 12 allow movement of the inner portion 7 with respect to the outer portion 10 from the first to the second configuration and prevent return to the first configuration and preferably lock the relative position of the inner and outer portions 7, 10 (possibly with some play) once the second configuration has been reached.

Advantageously, the second attachment means 12 are snap engagement means. For instance, they may comprise a protrusion 14 that is pushed outwards by an elastic member 15.

In the embodiment of FIGS. 1*a*-2*d*, the second attachment means comprise a pin (the protrusion 14), advantageously having a rectangular section, which is housed in a special seat 17 formed in the inner member 7 and is pushed by a spring (the elastic element 15) against outer portion 10.

In a preferred embodiment, multiple pins are provided, i.e. two. three or four pins. For assembly of the closure 1, the second attachment means 12 shall preferably extend through less than 360°, preferably not more than 180°, e.g. about 120°.

Referring to FIGS. 1*a*-3*d*, the inner surface 16 of the outer portion 10 comprises at least one respective seat 17 capable of receiving the second attachment means 12. Preferably, the shape of the seat/s 17 is substantially complementary to the shape of the attachment means 12.

Advantageously, there will be a seat 17, e.g. one single seat for each protrusion 14.

The axial distance between the second attachment means 12 and the seats 17 for engagement thereof may be of a few millimeters, thereby affording a displacement visible to the naked eye.

The preferred embodiment as shown in FIGS. 1*a*-3*d* shows that the inner portion 10 may comprise a movable member 18 with the second attachment means 12 applied thereto, that may be visible from the outside together with the cork 2 itself, which is fastened, advantageously glued to the movable member.

Figure 2A:
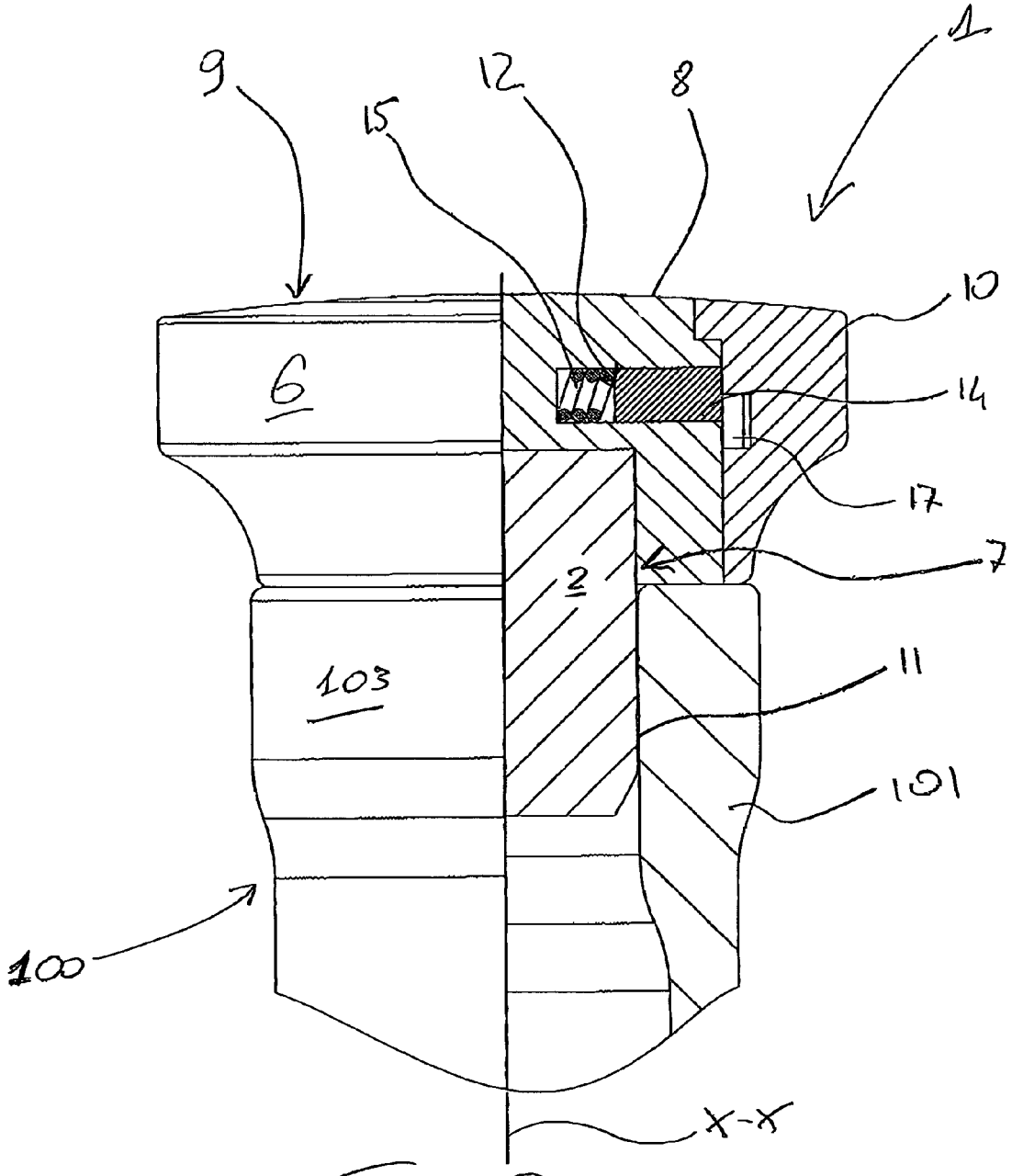
FIGS. 2*a*-2*d* show views like those of FIGS. 1*a*-1*d*, of a closure according to a second embodiment of the present invention (in which case, the reclosed closure has the same configuration it had during first opening)
Figure 2B:
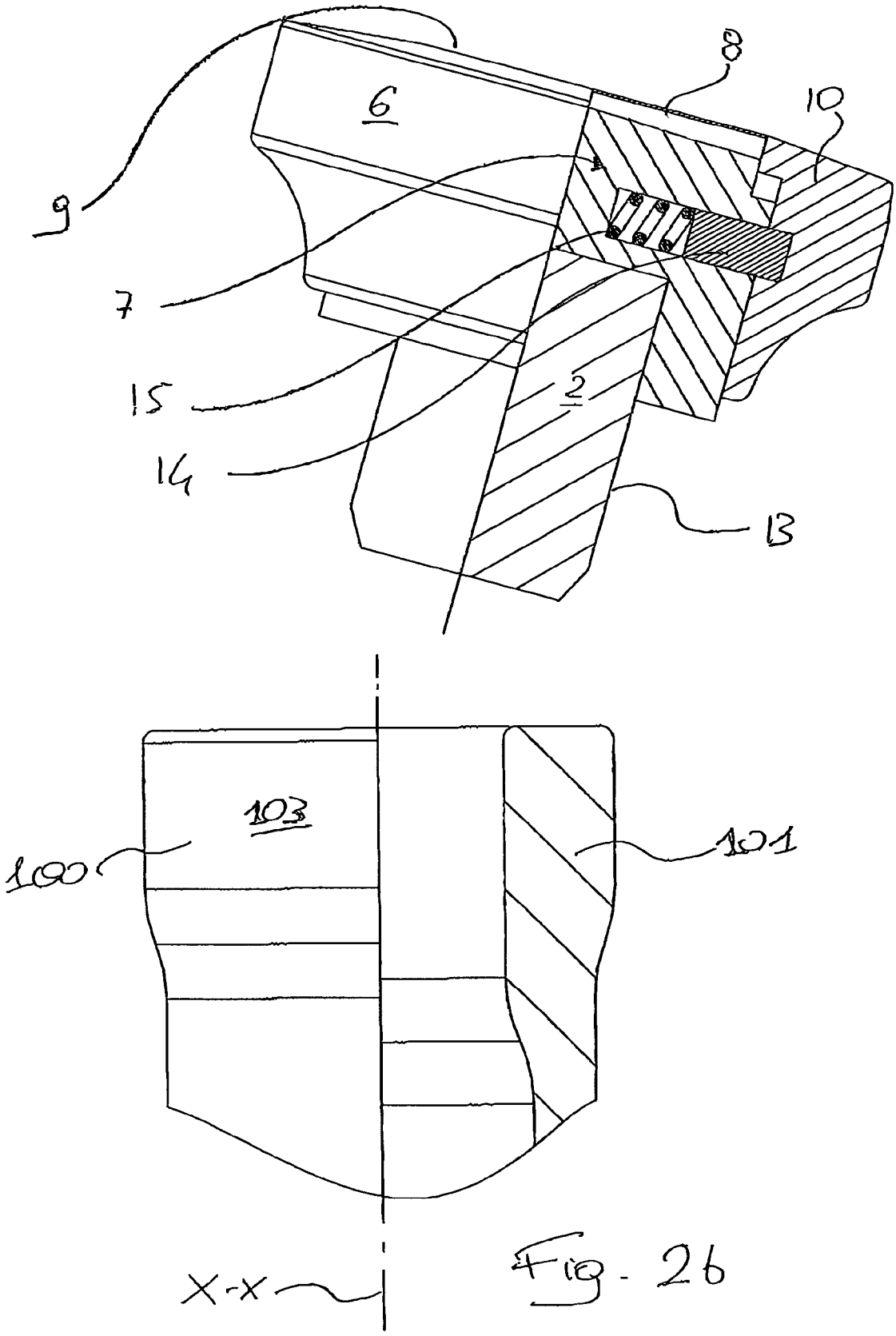
Figure 2C:
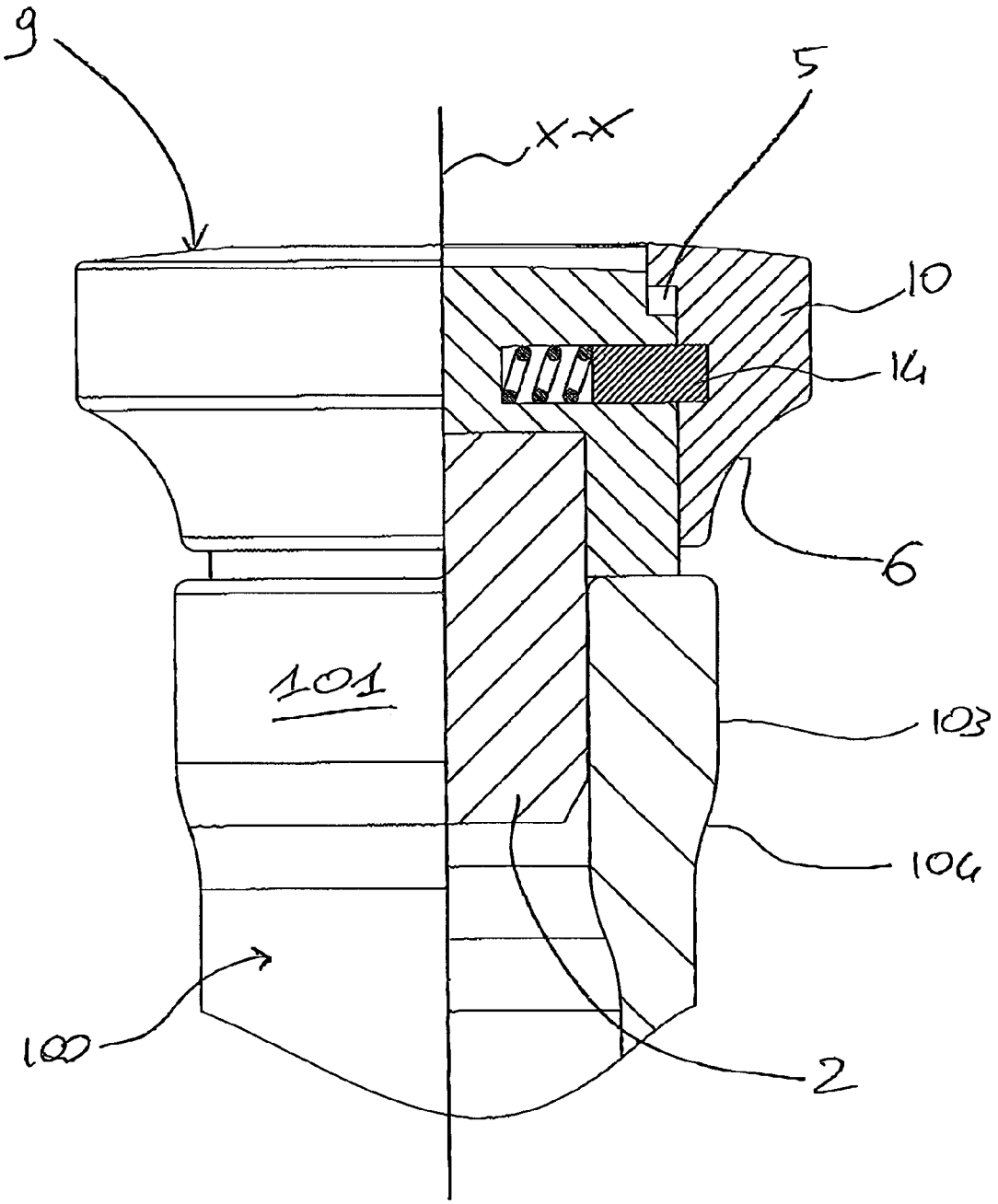
Figure 2D:
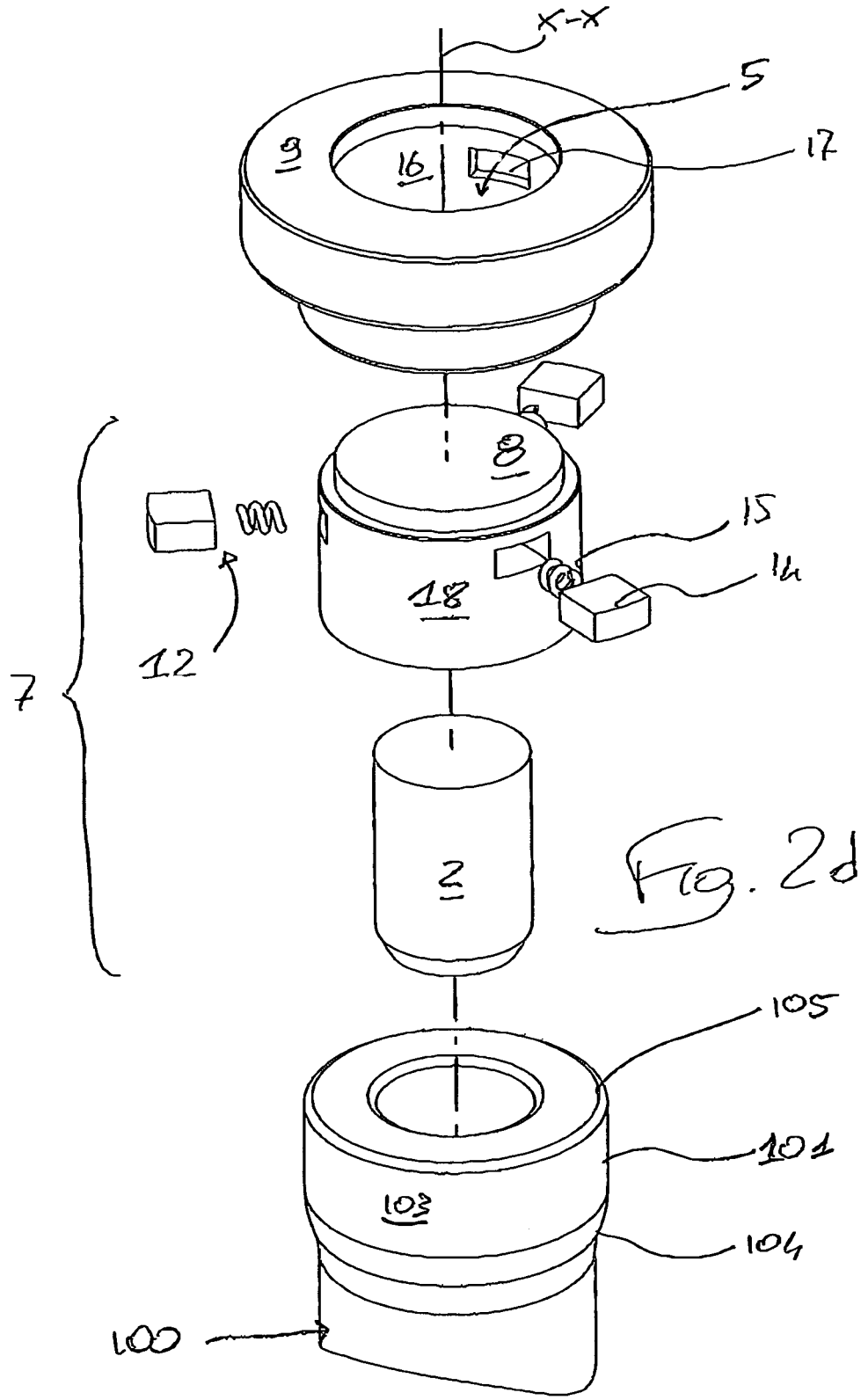

As shown from the comparison between FIGS. 1*a* and 2*a*, the lower end of the movable member 18 may or may not project out of the outer member 10 in which it is inserted: in the embodiment of FIGS. 2*a*-2*d*, the relative motion between the outer member 10 and the movable member 18 during first opening exposes the lower portion of the outer surface of the movable member 18, whereas in the embodiment of FIGS. 1*a*-1*d* the outer surface of the movable member 18 is covered by the outer member 10 even after first opening.

As shown, prior to first opening, the first attachment means 11 are stronger than the second attachment means 12, which are not engaged yet.

At the start of the first opening, the force exerted by the user to open the container 100 allows the closure 1 to move from the first configuration to the second configuration, as the longitudinal resistance of the first attachment means 11 is greater than the longitudinal force that can be transferred between the gripping surface 6 and the inner portion 7.

At the end of this starting step, the second attachment means 12 engage and the closure 1 can no longer change its configuration. In other words, the maximum longitudinal force that can be transferred by the second attachment means 12 is higher than the longitudinal resistance of the first attachment means 11.

Now, the force exerted by the user may overcome the resistance of the first attachment means 11 and the container 100 may be open.

Preferably, the above occurs without requiring the rupture of any element of the tamper evident system or optionally of the closure 1 itself.

The embodiments of the other figures will be now described, starting from FIGS. 3*a*-3*d*, with the assumption that, considering the important analogies with the embodiments described above, the differences will be only mentioned, whereby all that is not expressly described as different may be intended to be provided in a similar or identical manner.

In this embodiment, the gripping surface 5 and the inner member 7 may move relative to each other along the axis X-X. The main difference from the previous embodiment lies in the structures of the movable member 118 and the second attachment means 12.

The second attachment means 12 comprise a protrusion 114, advantageously formed of one piece with the inner member 7.

In this case, the snap engagement of the second attachment means 12 depends on the conformation of the inner member 7, which comprises an annular cavity 120 coaxial with the axis X-X. Such annular cavity 120 defines a substantially annular thin wall 121.

The protrusion 114 is formed on the thin wall 121 to face radially outwards, advantageously in the proximity of the top end of the wall 121.

Figure 3A:
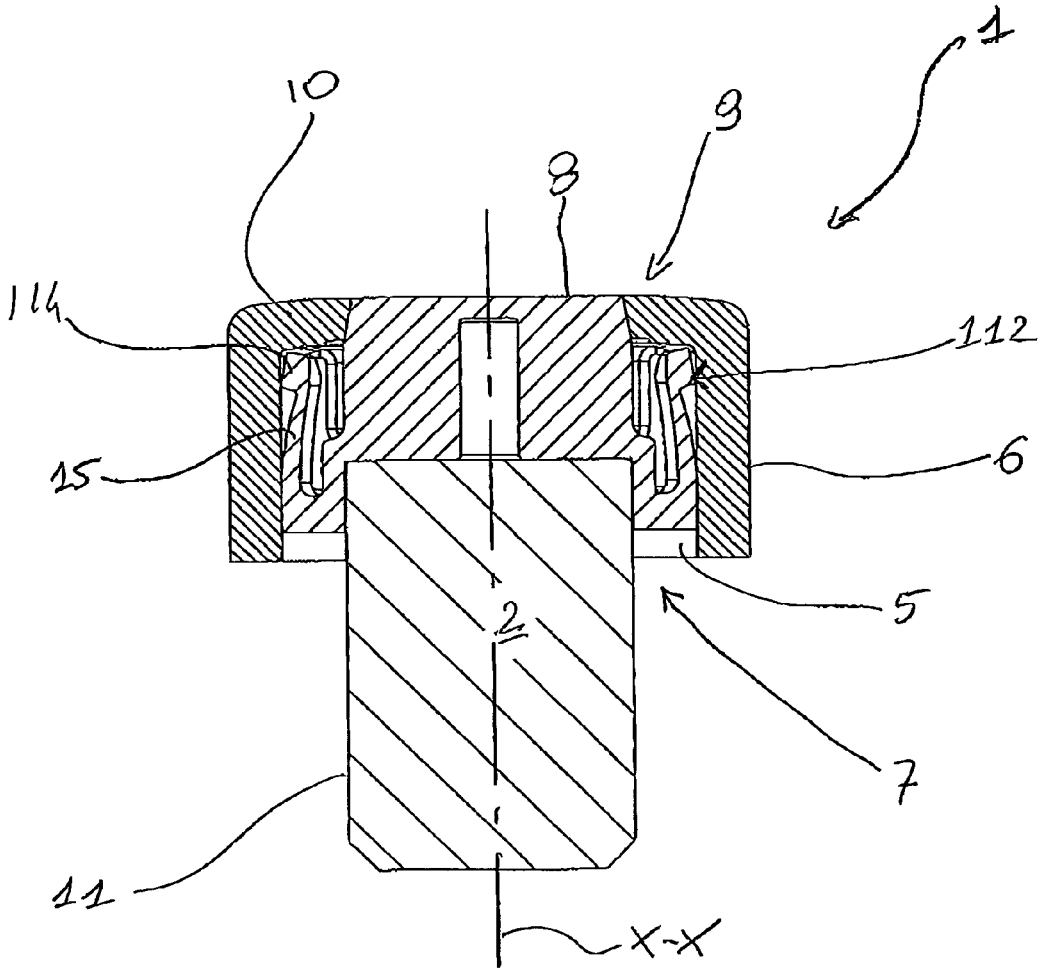
FIGS. 3*a*-3*c* show sectional views of a closure according to a third preferred embodiment of the present invention, in a pre-assembled configuration, in an assembled configuration prior to first opening and in a configuration after first opening.
Figure 3B:
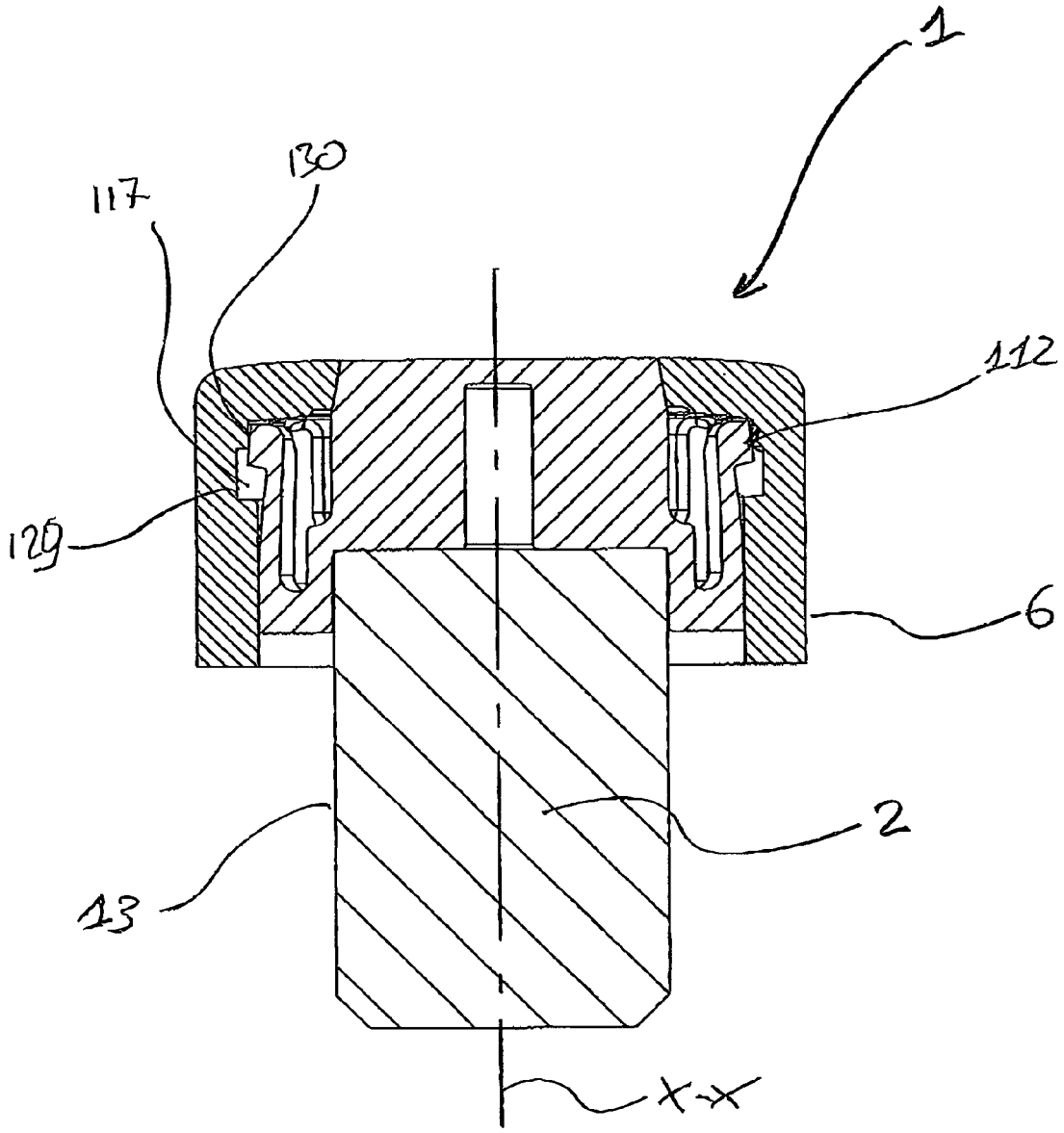
Figure 3C:
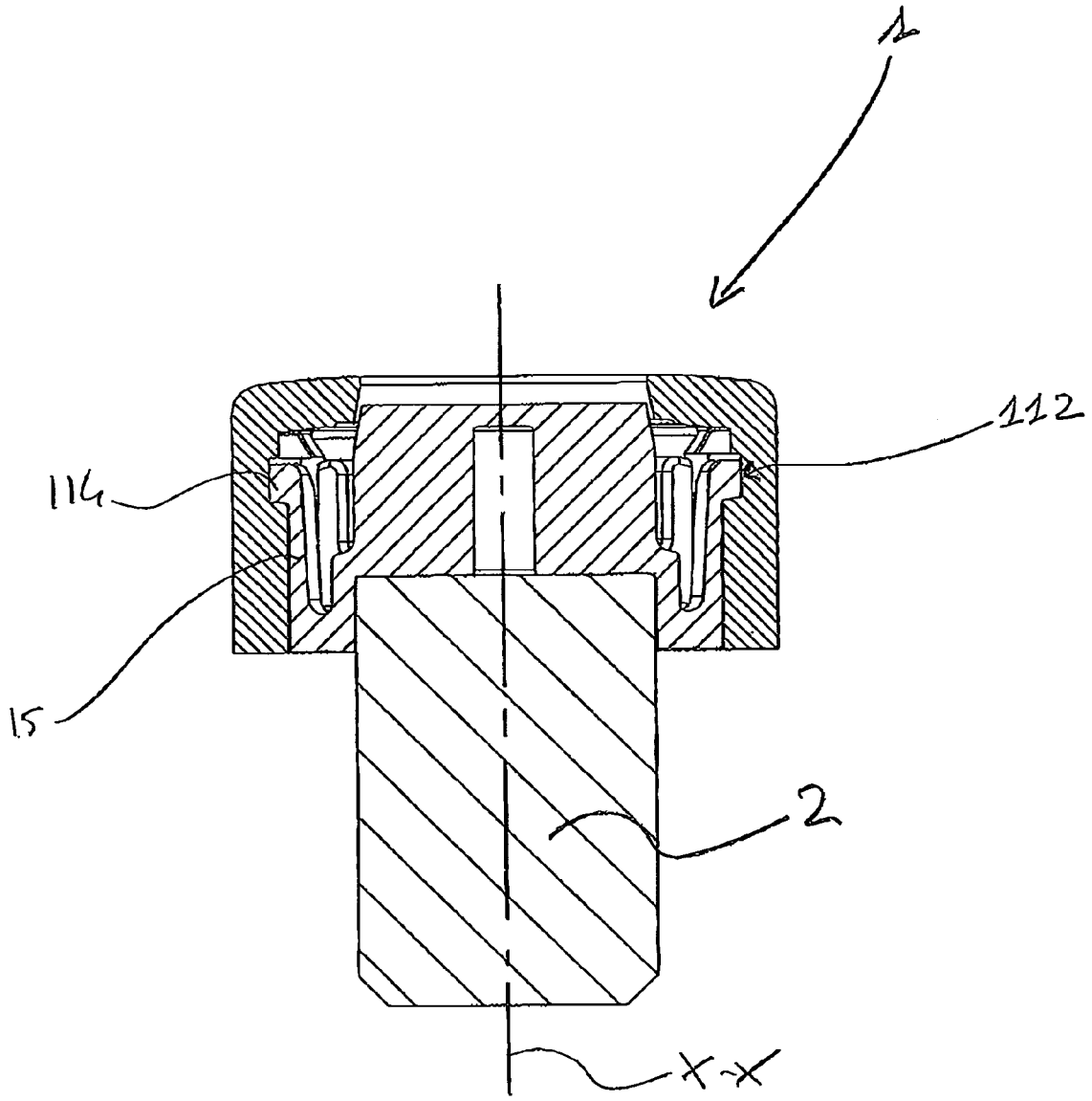
Figure 3D:
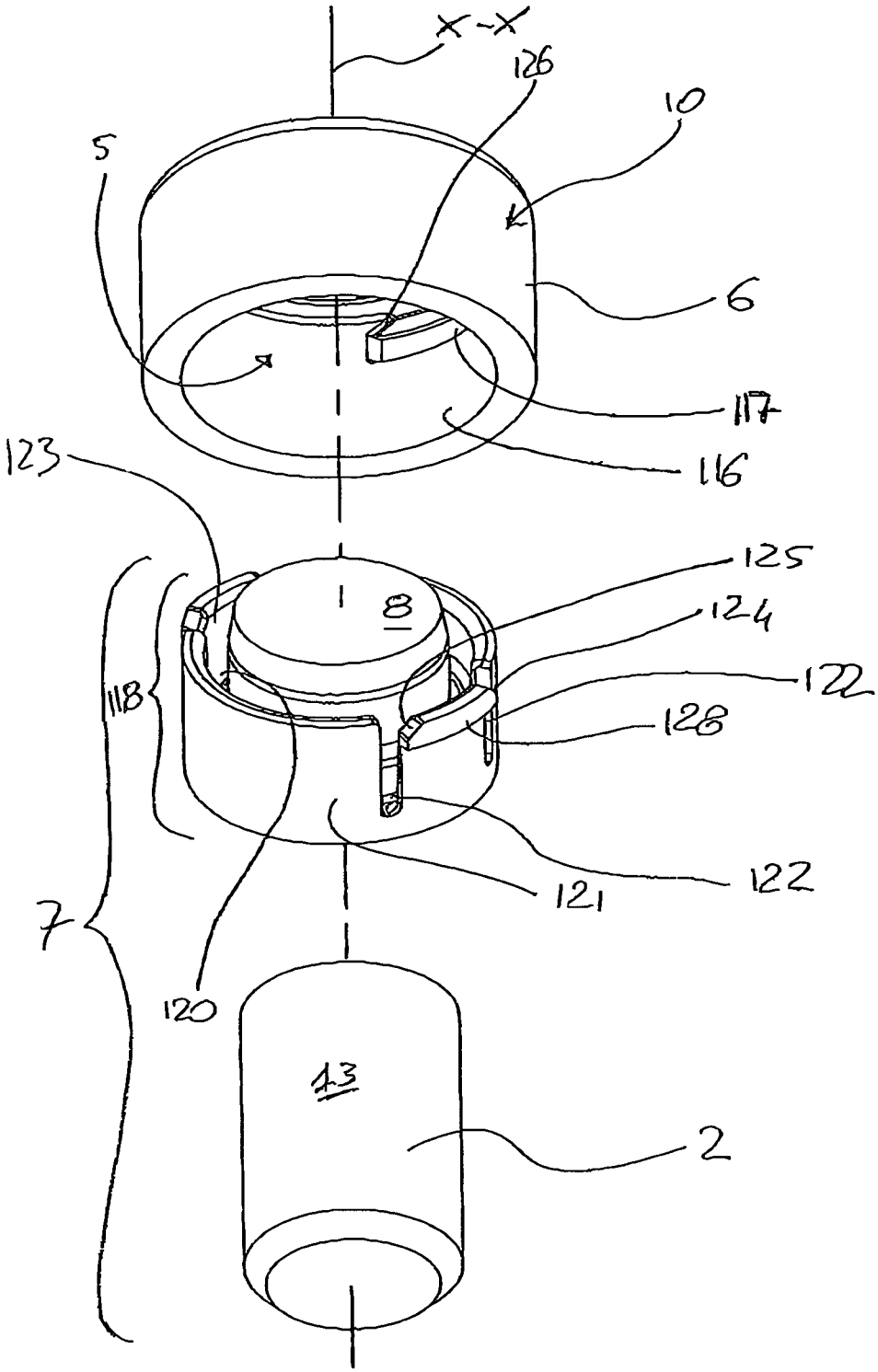
FIG. 3*d* shows an exploded view under alternate perspectives of the closure of FIGS. 3*a*-3*c;*
Figure 4D:
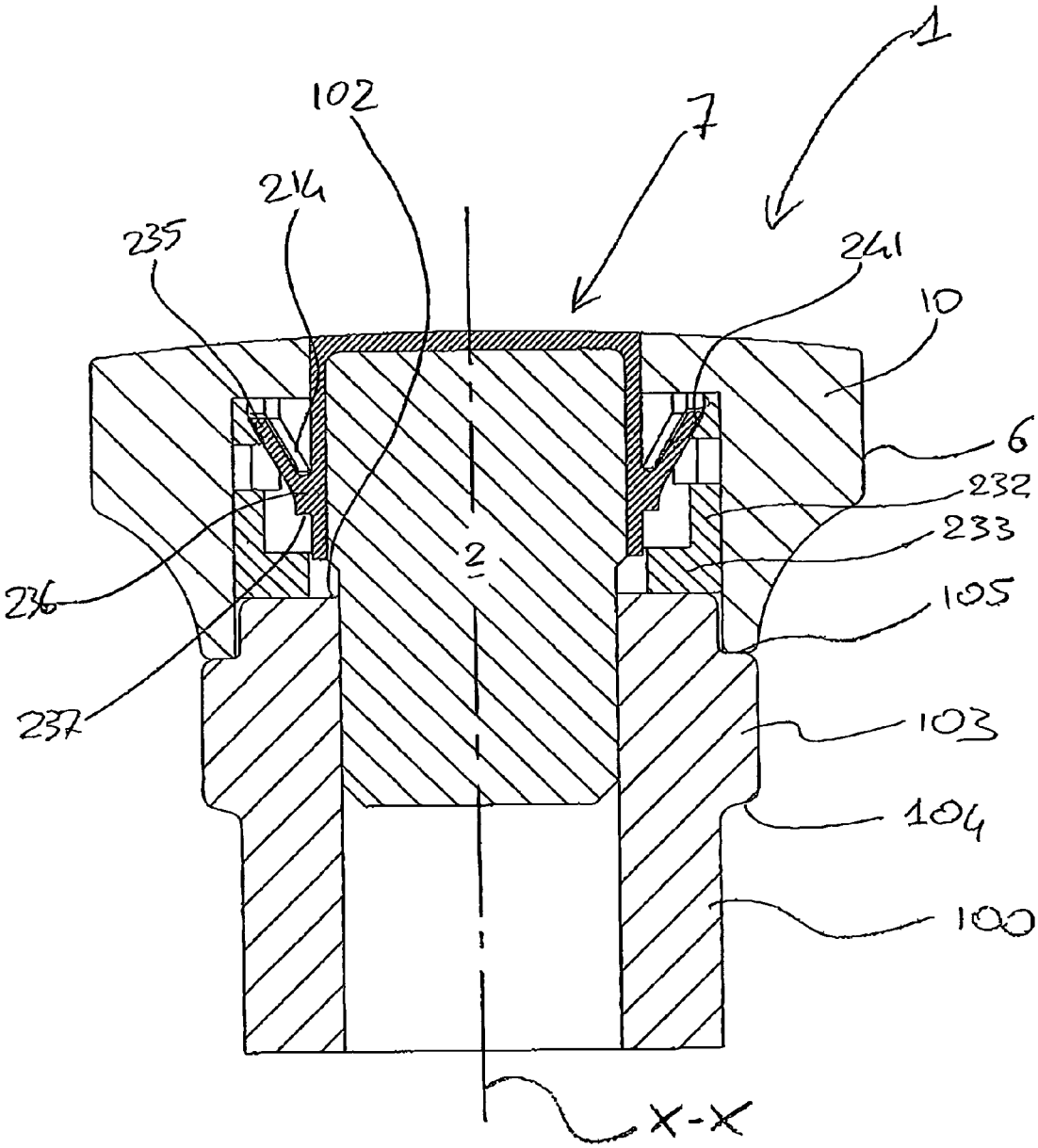
Figure 4B:
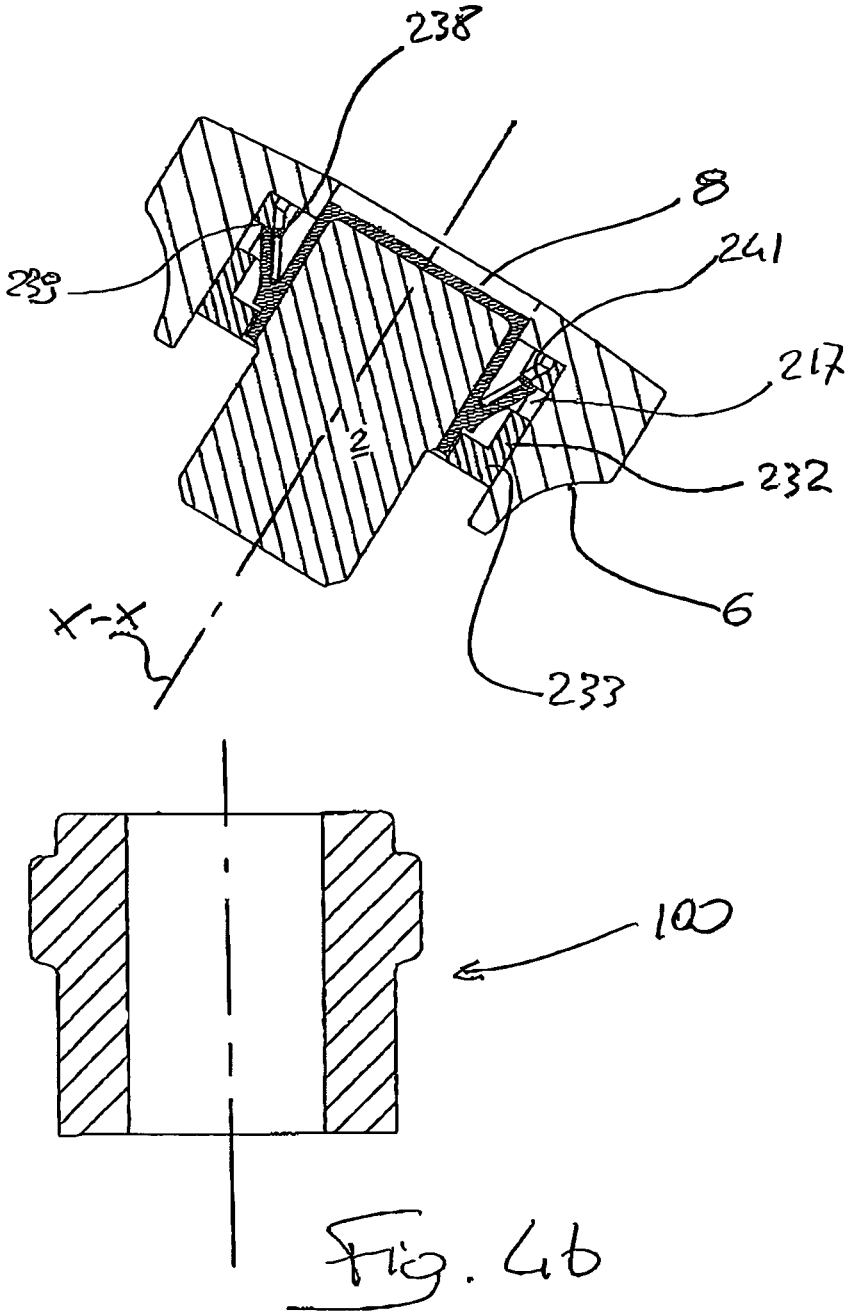
Figure 4C:
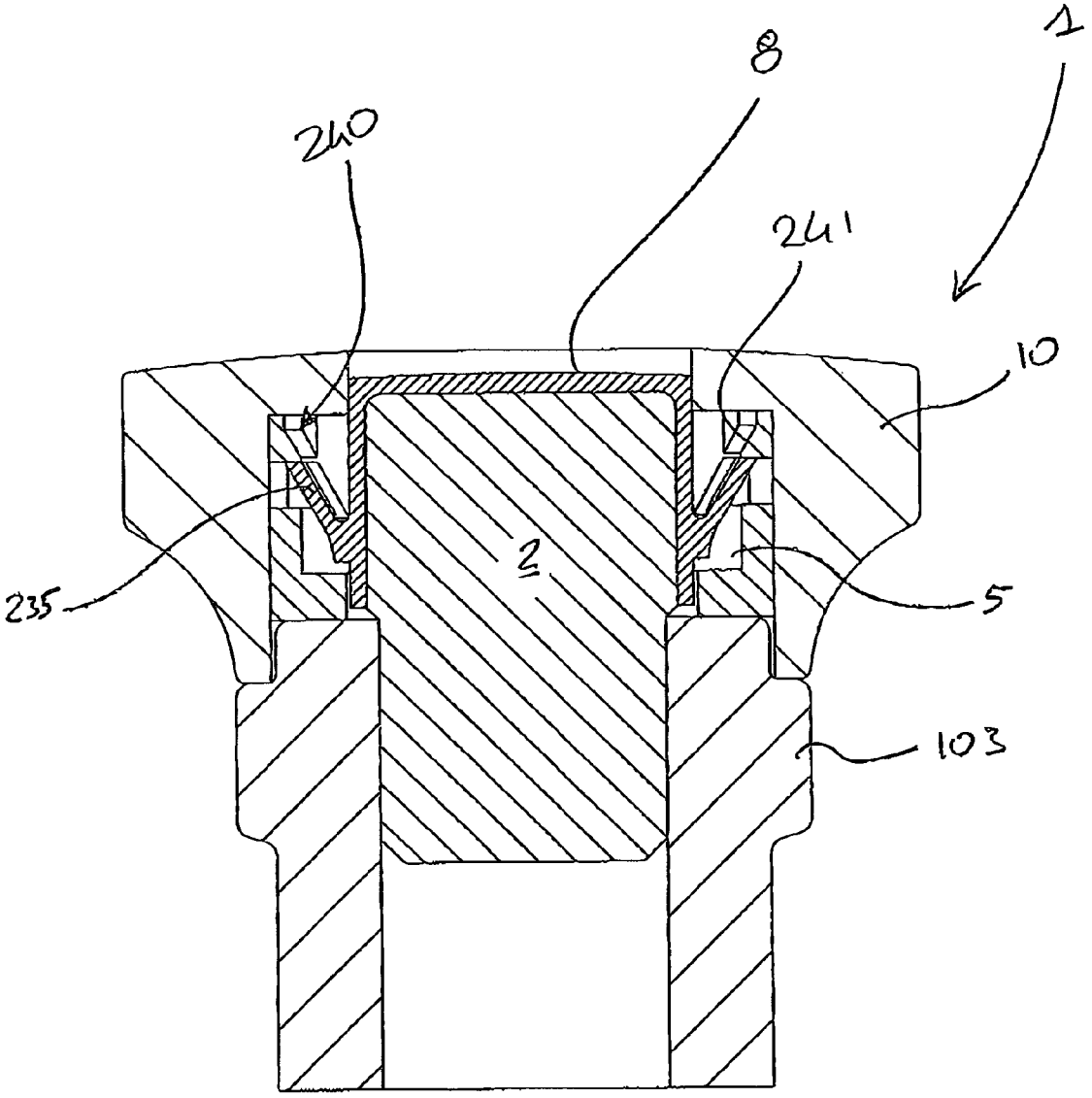
Figure 4D:
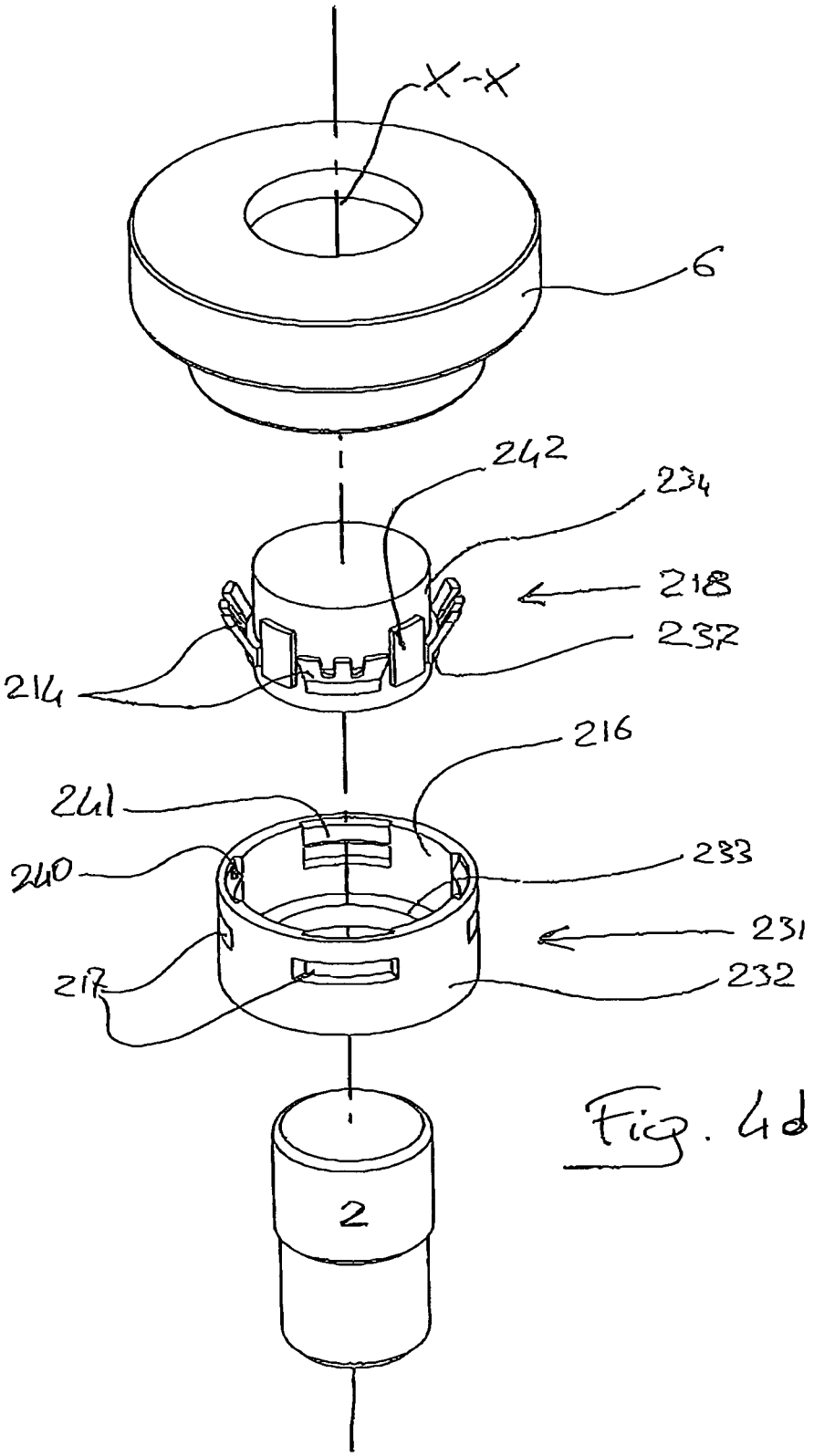

As shown in FIG. 3*d*, the thin wall 121 may have two slots 122, for instance placed at each side of the protrusion 114. Such slots 122 delimit a portion 123 of the thin wall 121 that can be even thinner than the rest of the thin wall 121. The circumferential extension and the thickness of the portion 123 may be changed to adjust the radial flexibility of the portion of the thin wall 121 with which the protrusion 114 is connected.

There may be embodiments with one, two, three or even more protrusions 114. Advantageously, they may be equally spaced along the circumference and lie on a single plane, transverse to the axis X-X. Different arrangements may be also considered, provided that the closure 1 can still be assembled and operated properly.

As shown in FIG. 3*d*, the protrusion 114 has two upper sides 124 and 125 inclined to the plane perpendicular to the axis X-X. The outer circumferential surface 128 of the protrusion 114 advantageously has a diameter greater than the diameter of the inner surface 116 of the outer member 10, to allow the portion of the thin wall 123 with which the protrusion 114 is connected to be elastically loaded.

FIG. 3*d* clearly shows the inner surface 116 of the outer member 10, which comprises at least one seat 117 capable of receiving the second attachment means 12.

Advantageously, there will be one seat 117 for each protrusion 114.

The seat 117 may have two upper sides 126 and 127 (the side 126 being only visible in FIG. 3*d*) inclined to the plane perpendicular to the axis X-X, preferably having the same inclination and/or corresponding to the inclined sides 124 and 125 of the protrusion 114.

The bottom surface of the seat 117 advantageously comprises two wall portions 129, 130 disposed at different radial depths of the inner surface 116.

Thus, the seat 117 may be considered as the resultant of two adjacent distinct seats, not separated from any physical element, each defined by the bottom wall 129, 130, and having different depths. Therefore, a first seat defined by the wall 129 and a second seat defined by the wall 130 may be recognized.

The wall 129, placed at a lower depth, has a position that matches the position assumed by the second attachment means 12 in the first configuration (see FIG. 3*b*). When the second attachment means 12 are engaged in the seat 117 and the closure 1 is in the first configuration, the engagement of the second attachment means 12 in the seat 117 only allows the inner portion 7 to move relative to the gripping surface 6 towards the second configuration.

The wall 130, placed at a greater depth and advantageously lower than the wall 129, allows engagement of the second attachment means 12 when the closure 1 is in the second configuration.

This particular closure 1 is assembled by first introducing the inner member 7 into the outer member 10. Advantageously, the inner member 7 is oriented angularly to the outer member 10 so that the second attachment means 12 cannot lock the closure 1 in the second configuration before reaching the first configuration. In other words, the angular orientation is selected so that the protrusions 114 cannot fit into the seat 117 when the inner member 7 is introduced into the outer member 10.

This step is useful because insertion occurs in the direction opposite to the direction in which the tamper evident means are actuated, i.e. the relative displacement occurs in a direction opposite to the direction in which the closure 1 moves from the first configuration to the second configuration.

Once the inner member 7 is fully inserted in the outer member 10, both are rotated relative to each other, e.g. by 90°, so that the second attachment means 12 can engage in the first configuration.

In practice, the protrusion 114 fits into the seat 117 and abuts against the shallower surface 129. The surface 129 is at such a depth as to prevent full relief of the potential elastic energy of the thin wall 123.

This axial component moves the closure 1 into the second configuration thereby further relieving the potential elastic energy of the thin wall 123.

The depth of the wall 130 is, for instance, larger than the diameter of the circumference circumscribed about the protrusions 114 at rest, which allows full relief of the potential elastic energy of the thin wall 123.

Referring now to FIGS. 4*a*-4*d*, it can be noted that the projection 103 of the container does not extend to the end of the mouth, but is upwardly delimited by a top surface 105 distinct from the mouth. In this case, like in the embodiments of FIGS. 1*a*-1*d*, the outer member 10 has a longitudinal extension greater than the inner portion 7.

In these embodiments, but also in the one as shown in FIGS. 3*a*-3*d*, the diameter of the seat 5 may be advantageously greater than the one of the neck 101 of the container 100, thereby covering the portion of the neck 101 above the projection 103, as shown in FIG. 4*a*.

In this embodiment, the outer member 10 is like those described above. The outer member 10, in this case, is not a single member, like in the other embodiments, but also comprises a distinct closure sleeve 231, comprising a side wall 232 and optionally a bottom wall 233 whose function is to retain the inner portion 7 in the closure 1, while the container 100 with the closure 1 applied thereon is opened and/or closed.

Then, the closure sleeve 231 is attached to the outer member, such as by gluing or interlocking arrangement.

The main difference of the inner portion 7 from the one of the embodiments as shown in FIGS. 1*a*-3*d* lies in the movable member 218, which has protrusions 214 formed, preferably in an integral fashion, on its outer surface 234.

The protrusions 214 are integrated with the elastic means 215. The protrusions 214 comprise one or more fingers 235, inclined to the longitudinal axis X-X to form a conical profile with a downward apex. Advantageously, each protrusion 214 comprises two, three or four fingers 235 and the movable member comprises two, three or four protrusions 214, for instance equally spaced along the circumference.

The fingers 235 and the axis X-X form an angle smaller than 60°, advantageously from 40° to 20°, for instance 30°.

The circumferential extension of the protrusions 214, in this case, might also cover 360°, but is smaller in the preferred embodiment, e.g. not greater than 180° or about 120°.

As shown in FIGS. 4*a*-4*d*, the fingers 235 are connected to the movable member 218 by spacers 236.

The inner portion 7 comprises stop means that can prevent it from descending relative to the gripping surface 6, beyond the position that corresponds to the second configuration.

Advantageously, these stop means comprise the bottom surface 237 of the spacers, which substantially abuts against the outer member 10, i.e. the flange 233 of the sleeve 231.

The sleeve 231 comprises the seats 217 that receive the protrusions 214. Like in the other embodiments, the engagement between the protrusion 214 and the seat 217 prevents the inner portion 7 from moving from the second configuration to the first configuration relative to the gripping surface 6. Like in the other embodiments, engagement is obtained by abutment between two (substantially) horizontal surfaces: the top surface (238, in FIG. 4*b*) of the protrusion 214 and the inner top surface (239, in FIG. 4*b*) of the seat 217.

Advantageously, the seat/s 217 of the sleeve 231 may extend through the whole thickness of the side wall 232.

The sleeve 231 may have insert seats 240. These seats 240 may be located above the seats 217. Advantageously, the seats 217 and the insert seats 240 have the same circumferential extension.

The seats 240 are advantageously open at the top and/or have a bottom surface 241 inclined downwards, preferably at the same angle of inclination of the fingers 235.

The movable member 218 may also comprise plates 242, possibly integrally formed, e.g. alternated with the protrusions 214. These plates 242 are substantially as thick as the spacers 236.

The top surface of the plates 242 is at such a level as to stop the upward movement of the movable member for its top surface to be aligned with the top surface of the outer member 10.

Thus, during manufacture of the closure 1, a mechanical stop allows proper assembly of the parts, even with high speed automatic processes.

Referring to the embodiment as shown in FIGS. 5*a*-5*d*, the closure 1 comprises internal threads 3 for engagement with external threads 106 integral with the container 100.

The external threads 106 may be formed directly on the neck 101 of the container 100 or, like in the case of the figure, on a closure body 350 designed to be fitted onto the neck 101 of the container 100

The closure body 350 and the closure 1 form together a closure assembly.

The closure body 350 comprises the elements integral with the container, whereas the closure 1 is what is integrated with the closure body 350 to prevent liquid from leaking out of the container 100 having the closure assembly thereon.

The closure body 350 may comprise, for instance, a threaded sleeve 351 with external threads formed thereon. Such threaded sleeve 351 may comprise a pouring spout 352 and/or may be integrated with the container 100 by appropriate attachment means 353, such as tabs engaging against the bottom surface 104 of the projection 103.

The closure body 350 may comprise anti-refill means, such as a washer 354 which holds, possibly in combination with the threaded sleeve 351, a ball 355, or a valve like the one disclosed in Application No. PCT/GB2004/000189 (or similar to it) thereby forming a non-refillable valve system.

For the closure body 350 to be less likely to be released from the neck 101 of the container 100, the closure body may comprise an additional sleeve 356.

All these construction characteristics are known in the art and may be changed as desired by a skilled person, without changing the basic principle of the present invention. Therefore, they will not be further described.

This closure 1, which is designed to be opened by an unscrewing action, instead of a longitudinal pulling action, is based on certain concepts of the embodiment of FIGS. 3*a*-3*d* and certain other concepts of the embodiment of FIGS. 4*a*-4*d*.

Figure 5D:
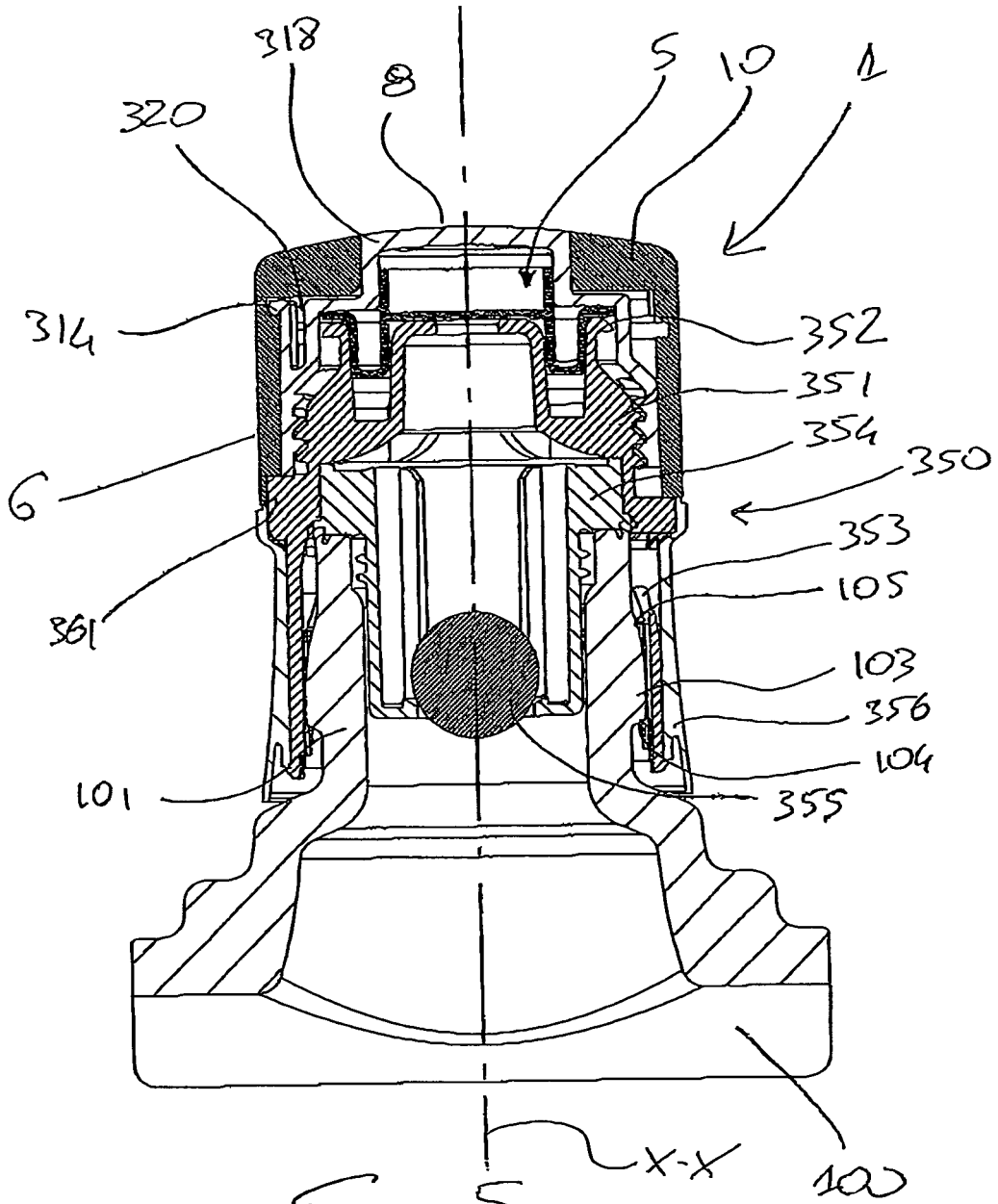
FIG. 5*d* shows an exploded perspective view of the closure of FIGS. 5*a*-5*c;*
Figure 5B:
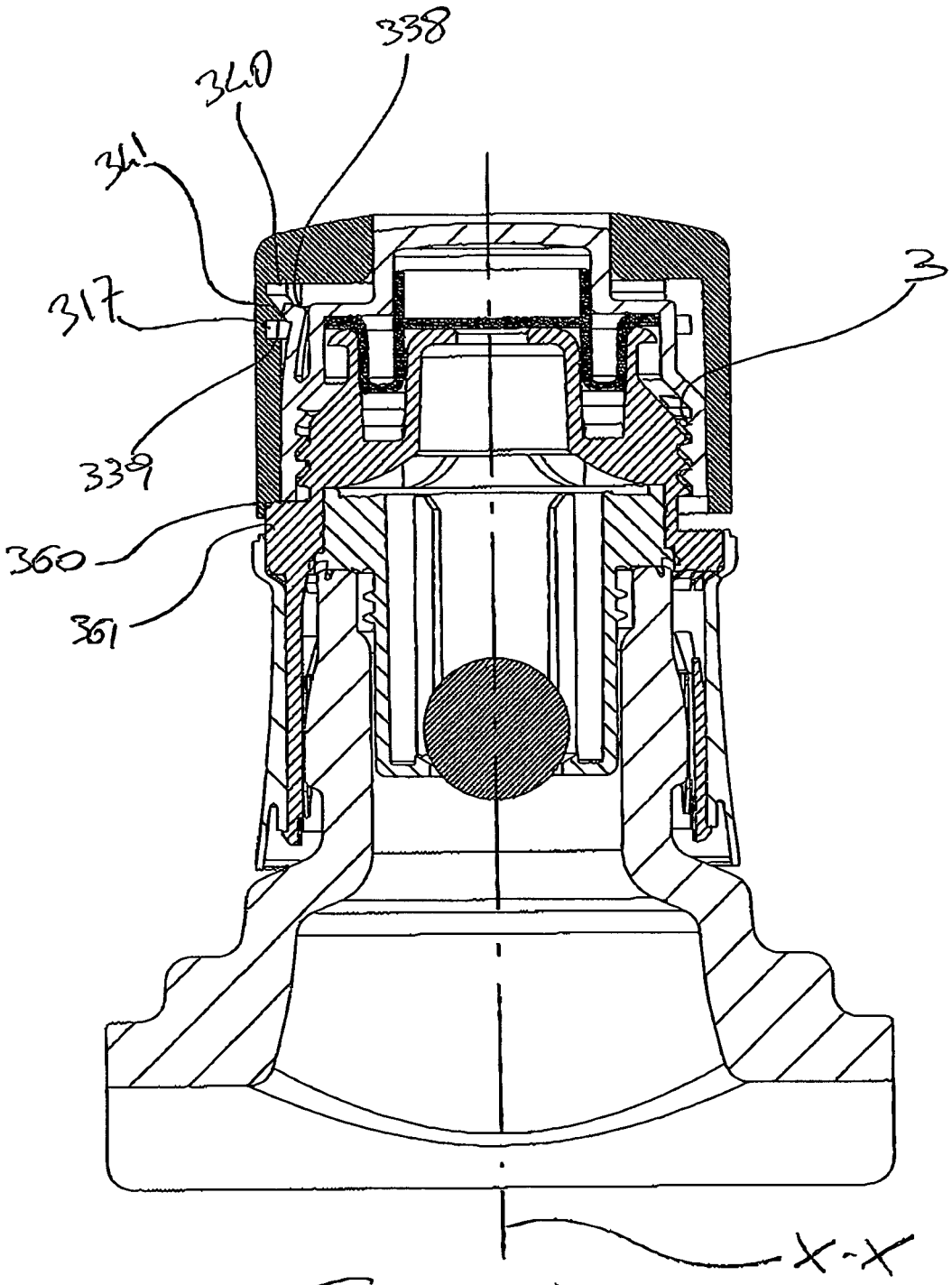
Figure 5C:
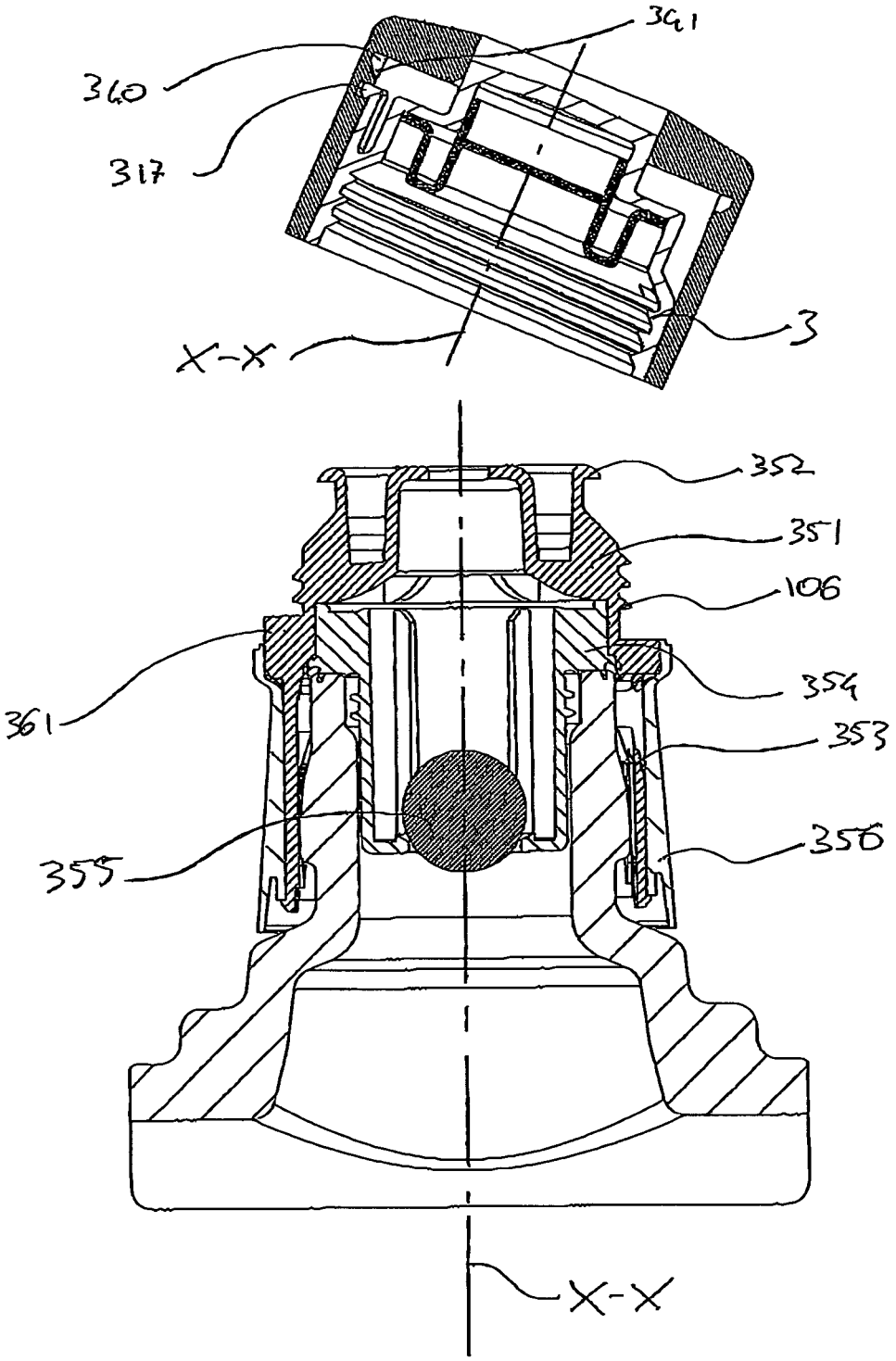
Figure 5D:
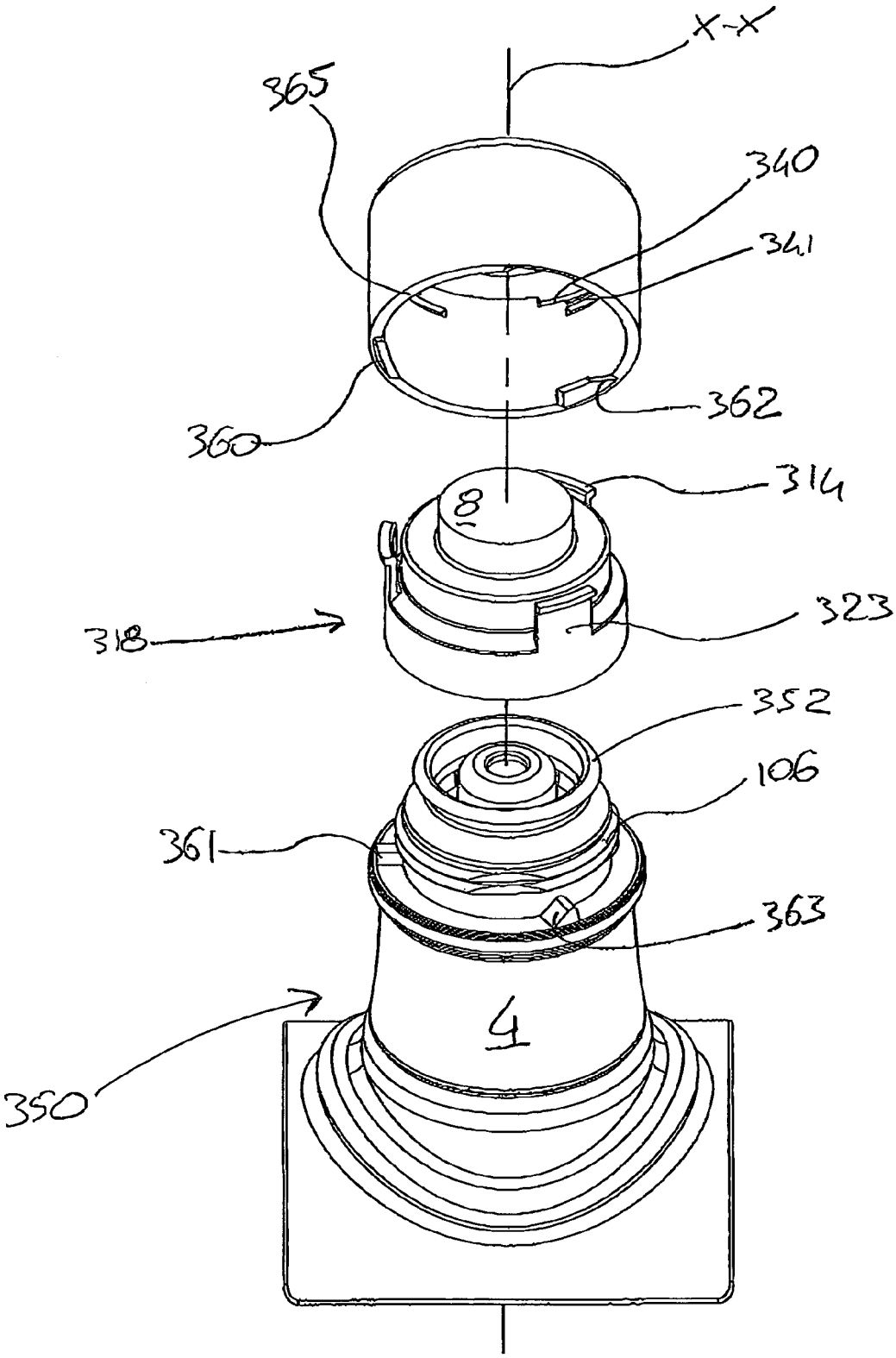

The structure of the outer member 10 is like the one of FIG. 3*d*: it comprises a movable member 318, having thereon the portion 8 of the top surface 9 of the closure 1 that descends during first opening, as well as the protrusions 314 and the elastic means 315 consisting of thin walls 323. Although FIG. 5*d* shows neither the side wall designated by numeral 121 in FIG. 3*d*, nor a clearly defined annular cavity 120, the two embodiments of the elastic means may be interchanged.

Likewise, the movable member 318 may be assembled with the outer member 10 of FIGS. 5*a*-5*d* by axially inserting and then rotating it, like for the corresponding members of FIGS. 3*a*-3*d*.

Also, two seats 317, 340 are visible in FIGS. 5*a*-5*d*, the second comprising a downwardly inclined surface 341. Advantageously, the surface 341 is located above the seat 317.

In fact, the operation of the second attachment means 312 of this embodiment is similar to the operation of the second attachment means 212 of the embodiment of FIGS. 4*a*-4*d*: a relative axial movement between the gripping surface 6 and the inner portion 7 first causes the protrusions 314, 214 to slide down the inclined surfaces 341, 241, thereby loading the elastic means 315, 215.

Then, once the relative longitudinal motion has pushed the protrusions 314, 214 level with the seats 317, 217, the elastic means 315, 215 snap the protrusions 314, 214 into their seats 317, 217, thereby causing the top surfaces 338, 238 of the protrusions 314, 214 to abut against the upper inner surfaces 339, 239 of the seats 317, 217.

Obviously, in the embodiment of FIGS. 5*a*-5*d*. a rotation shall be accounted for to exactly determine the relative radial extensions of the seats 340 and 317.

As shown in FIG. 5*d*, for example, this may involve that only part of the seat 340 has an inclined bottom surface 341, and the remaining part (e.g. the upstream part, considering the direction of relative rotation) may be substantially perpendicular to the axis X-X.

In short, this analogy shows that each of the above preferred embodiments may be changed by the use of second attachment means wholly or partially taken from other preferred embodiments, with no effort by any skilled person that should read this description.

For a more accurate and easier definition of the relative descending movement, the outer member 10 comprises one or more lower seats 360 opening towards seat 5 and the bottom edge 365 of the outer member 10.

These lower seats have an inclined wall 362, which is adapted to cooperate with the corresponding inclined surface 363 of a cam 361 integral with the external threads 106.

For example, the cam 361 may be formed on an appropriate flange of the threaded sleeve 351 and/or the outer sleeve 356 and/or another element integral with the external threads 106.

The cam 361 is used to convert a relative angular displacement between the gripping surface 6 (i.e. the outer member 10 of the closure 1) and the container 100 (or the external threads 106, or the closure body 350, or the cam 361 itself) into a relative longitudinal motion between these parts.

Since the inner member 7 is longitudinally attached to the container by the first attachment means 11 (i.e. the temporary attachment means), in this case by the threaded coupling between the internal threads 3 and the external threads 106, the cam 361 imparts a longitudinal displacement between the gripping surface 6 and the inner member 7, thereby actuating the tamper evident feature.

As shown by the comparison between the FIGS. 5*a* and 5*d*, the inner member 7 is unaffected by the presence of the cam 361, e.g. because the lower limit of the inner member 7 is at a higher level than the upper limit of the cam 361. Alternatively, the cam 361 might be radially external to the inner member 7.

As shown by the present description and by the comparison of the embodiments of FIGS. 3*a*-5*d*, the second attachment means (or irreversible attachment means) comprise a protrusion 114, 214, 314 connected by elastic means 123, 223, 323 to the inner member 7.

The protrusion 114, 214, 314 is movable between a first position corresponding to the configuration of the closure 1 prior to first opening and a second configuration of the closure 1 after (immediately after) first opening.

During its movement between the first configuration and the second configuration, the protrusion 114, 214, 314 is longitudinally displaced relative to the gripping surface 6 and a special relief arrangement allows the elastic energy accumulated in the elastic means to be relieved.

The relief arrangement may comprise a radial step, whereby as the protrusion 114, 214, 314 descends relative to the gripping surface 6, it moves from a position closer to the axis X-X to a position farther from the axis X-X.

Advantageously, the relief arrangement operates in one way, i.e. does not allow reverse motion. For example, it allows a snap motion.

Therefore, the relief arrangement may be interposed between two successive radial seats having different depths (FIGS. 3*a*-4*d*), possibly adjacent (FIGS. 3*a*-3*d*), or two seats separated by a wall (FIGS. 4*a*-5*d*). The wall may be an inclined wall 241, 341 to allow loading of the elastic means.

The relief arrangement and the seat/s that define it may be integrally formed in the outer member 10, or in an added element (FIGS. 4*a*-4*d*), such as a sleeve 231, that may be appropriately attached to the outer member 10.

Referring now to the embodiment as shown in FIGS. 6*a*-6*e*, closure 1 comprises internal threading 3 for engagement with external thread 106 integral with the container 100.

In this embodiment, the closure body 350 may be very similar or identical to the closure body 350 as described with reference to the embodiment of FIGS. 5*a*-5*d*.

The main difference from the embodiment of FIGS. 5*a*-5*d* consists in that the inner member 7 is divided into two members 71, 72, which are fixedly engaged with each other, so that the outer member 10 is trapped between them.

Advantageously, the two elements 71, 72 may engage with each other by snap-fitting, although other fastening arrangements may be envisaged, such as gluing, force-fitting and/or welding, e.g. ultrasonic welding.

The first member 71 comprises part 8 of top surface 9 of closure 1, which may be lowered relative to remaining part 10*m* of top surface 9, whereas second member 72 comprises reversible attachment means 11. Although the embodiment of FIGS. 6*a*-6*d* shows the reversible attachment means 11 as being the thread 3, it shall be understood that the same closure structure 1 may be used when the reversible attachment means 11 are the outer surface 13 of the cork 2.

The second member 72 may comprise a radial surface 721, e.g. having an annular shape, which is substantially perpendicular to the longitudinal axis X-X of the closure 1. The surface 721 forms an abutment for outer member 10, in the configuration that corresponds to the configuration prior to first opening.

The second member 72 may also comprise a first inner engagement member 722, e.g. made of teeth 723 arranged along one or more substantially vertical fingers 724. For example, fingers 724 may generally have a substantially cylindrical shape, coaxial with axis X-X. Advantageously, more than one finger 724 will be provided to ensure enough flexibility and resistance for the desired functions, as more clearly shown hereinbelow.

Advantageously, teeth 723 are located at the upper end of fingers 724, the lower end being integral with the rest of second member 72.

In a preferred embodiment, there are four fingers 724, each extending through a little less than 90° and each having a tooth 723, e.g. projecting outwards, whose circumferential extension is substantially identical or identical to that of finger 724 on which it is located.

The first member 71 may substantially have a mushroom shape, delimited at the top by central part 8. The second inner engagement member 712, which is adapted to engage with the first inner engagement member 722 so as to provide fixed engagement of the first member 71 with the second member 72, branches off from below central part 8.

As more clearly shown below, the first and second inner engagement members 722, 711 are designed so that disengagement during normal operation of the closure 1 is prevented, and namely to cause the first and second members 71, 72 to behave as one piece with respect to the working of closure 1.

For example, second engagement member 711 may comprise fingers 714 and/or teeth 713 like fingers 724 and teeth 723 of second member 72. In the embodiment as shown in FIGS. 6*a*-6*e*, fingers 714 are internal to fingers 724 and teeth 713 project outwards.

The first member 71 may further comprise an engagement portion 715 for engagement with outer member 10, as described below. Preferably, such portion 715 is made on the second inner engagement member 712.

Advantageously, the radial extension of second inner engagement member 712 is smaller than the radial extension of central part 8, so that there will be a bottom abutment surface 81 that is large enough to ensure that outer member 10 is gripped between the radial surface 721 and the bottom surface 81. Preferably, the bottom surface 81 has an annular shape.

Conveniently, second inner engagement member 722 internally engages with first inner engagement member 712.

The outer member 10 may receive first and/or second members 71, 72 in seat 5. Conveniently, outer member 10 comprises a protrusion 10*a* interposed between first and second members 71, 72.

The projection of protrusion 10*a* on a plane perpendicular to axis X-X, i.e. the direction of relative motion between outer member 10 and central portion 7, overlaps the projections, on one plane, of both central part 8 and radial surface 721.

In one preferred embodiment, protrusion 10*a* comprises a lip 10*b*, e.g. located below bottom surface 9 of closure 1, advantageously entirely located therebelow.

The lip 10*b* may have a continuous circumferential 360° extension or less; more advantageously, it is divided into a plurality of mutually spaced elements, globally extending all along the circumference.

In the embodiment of FIGS. 6*a*-6*e*, lip 10*b* is located at the lower end of a finger 10*c*, which finger 10*c* is joined at its opposite end to top surface 10*m* of the outer portion 10, e.g. to the inner edge of upper surface 10*m*, adjacent to first member 71.

Advantageously, the surface of finger 10*c* that faces toward axis X-X comprises a first portion 10*d*, adapted to allow a relative axial sliding motion of the first member 71; preferably, the shape of this first portion 10*d* substantially mates the shape of the central part 8, and preferably the first portion 10*d* has a cylindrical shape.

An abutment surface 10*e* is located below first portion 10*d*, and has the purpose of limiting such relative axial sliding motion by abutting against bottom surface 81 during first opening. The abutment surface 10*e* advantageously has an annular shape and is internal to first portion 10*d*.

The finger 10*c* has a second portion 10*f* below abutment surface 10*e*, with lip 10*b* located at its lower end. Thus, the inner surface of second portion 10*f* may advantageously comprise a conical section 10*g*, with the apex facing downwards, e.g. at the inner surface of lip 10*b*.

The lip 10*b* engages with engagement portion 715 of first member 71, for instance because engagement portion 715 is directly adjacent to lip 10*b* or conical section 10*g*.

Thus, during the rising motion of the outer portion 10 relative to first member 71, conical section 10*g* is moved against portion 715, thereby causing conical section 10*g* to move away from axis X-X.

It is clear that other configurations are possible, as long as protrusion 10*a* (and/or lip 10*b* and/or finger 10*c*) of outer portion 10 is elastically loaded, e.g. outwards, during longitudinal relative motion relative to first member 71 (and/or relative to first inner engagement member 712 and/or relative to engagement portion 715).

The first member 71 comprises an outwardly facing seat 716 which has such a shape as to cause protrusion 10*a* to prop thereagainst, thereby preventing any downward motion of protrusion 10*a*, relative to first member 71. In other words, seat 716 is located above engagement portion 715, so that, as protrusion 10*a* passes over engagement portion 715, it can fit into seat 716, which prevents protrusion 10 from passing over engagement portion 715 again in opposite direction, e.g. by means of an abutment surface 717 substantially perpendicular to axis X-X and preferably facing upwards.

For example, seat 716 may be formed as a circumferential groove or as successive portions of a circumferential groove.

Advantageously, protrusion 10*a* has at its lower end an abutment surface 10*h* substantially perpendicular to axis X-X, which can ensure a prop engagement with abutment surface 717.

Conveniently, the longitudinal distance between surfaces 10*h* and 10*e* is equal or substantially equal to the longitudinal distance between surfaces 81 and 717 so that, after first opening, outer portion 10 can no longer longitudinally move relative to inner member 7 (and/or relative to gripping surface 6).

In a preferred embodiment, protrusion 10*a* can be divided into two, three, four or more identical or substantially identical sectors, in equally circumferentially spaced arrangements. Three or four sectors (four in the figures) are preferably provided. Each sector has one or more lips 10*b*, e.g. two, three, four, five, six, ten, twelve or more teeth, separated by breaks 10*i* in the continuity of the protrusion. Preferably, there are four, five or six lips for each sector (five in the figures).

The breaks in the continuity of the protrusion may be of either a first type 10*i* and extend longitudinally up to second portion 10*f*, without reaching first portion 10*d* or a second type 10*k* and extend longitudinally up to first portion 10*d* including the entire first portion 10*d* as well.

Advantageously, at least one tooth 10*b* is delimited at both sides by such breaks 10*k* of the second type. For example, one of such teeth 10*b* may be provided for each sector.

Conveniently, surface 10*n*, opposite to top surface 10*m*, comprises a tamperproof structure that allows deformation of top surface 10*m* in response to any attempt to force closure 1 to move from the second configuration to the first configuration after first opening.

The tamperproof structure may be formed by a weakened portion, possibly obtained by radial grooves (not shown). The radial grooves may be arranged in correspondence of one or more breaks of the second type 10*k*, preferably in correspondence of all the breaks of the second type 10*k*.

Thus, the breaks of the second type 10*k*, together with the radial grooves, form a prop that can prop against first member 71, and which is substantially hinged at a distance from the inner edge of top surface 10*m*. Advantageously, the weakened portion is not obtained by through cuts, to allow shear forces to be transferred to the prop during first opening and to allow tooth 10*b* associated therewith to more easily pass over engagement portion 715.

In other words, closure 1 further comprises tamperproof means that can deform top surface 9, and advantageously only top surface 10*m* of outer member 10, before closure 1 can move from the second to the first configurations.

In order to allow relative motion between gripping surface 6 and the central portion, if the first reversible attachment means 11 are threads 3, the closure 1 advantageously comprises lower seats 360, that may be perfectly analogous to those of the embodiment of FIGS. 5*a*-5*d*.

These lower seats 360 are arranged in correspondence of respective cams 361, also analogous to those of the embodiment of FIGS. 5*a*-5*d*. As shown by the comparison of FIGS. 5*a*-5*d* and 6*a*-6*e*, cams 361 and lower seats 360 do not need to have both an inclined wall, but it is simply needed one inclined wall in either of them, preferably in lower seats 360. Likewise, the same technical effect may be achieved by a single lower seat 360 coupled to a single cam 361, a greater number of couplings being advantageous for balancing forces.

The lower seats 360 may comprise a ridge 360*b* (as shown in FIG. 6*b*), which prevents any accidental rotation of closure 1 and hence any accidental triggering of the tamperproof device.

Unlike the embodiment of FIGS. 5*a*-5*d*, inner member 7 comprises one or more ribs 728, preferably formed on outer surface 725 of second member 72, which are designed for abutting engagement with corresponding ribs 10*p* formed in outer member 10, whose purpose will be clearer below.

Advantageously, ribs 728 are contained in a cylinder whose diameter is equal to the diameter of lower edge 726 of second member 72 and preferably reach radial surface 721, and extend along most of the height of second member 72. Near lower edge 726, second member 72 may comprise a circumferential annular ridge 727, whose height is, for instance, about 25-40% the total extension of ribs 728. Advantageously, there will be 4 ribs 728, but there may be also three, two or more than four of them.

The closure 1 of the preferred embodiment is assembled through the following successive steps:

(a) Second member 72 is constrained to lower element 4;

(b) Then, outer portion 10 is fitted on second member 72;

(c) Later, first member 71 is constrained to second member 72, with outer portion 10 trapped therebetween.

The step (b) may advantageously comprise the following step:

(b1) Outer portion 10 is rotated relative to lower element 4, until ribs 728 abut against ribs 10*p*, and lower slots 360 are aligned with cam(s) 361.

The step (b1) may advantageously occur at the same time as or be followed by a relative longitudinal motion between outer portion 10 and second member 72, to allow cam(s) 361 to fit into slot(s) 360.

Obviously, no limitation shall be implied in that the description has been given with reference to a descending motion of the central portion 7 relative to the gripping surface 6, as the invention may be likewise described with reference to an ascending motion of the gripping surface 6 relative to the central portion 7.

In fact, during first opening, a user will grasp the exterior of the closure 1 (i.e. the gripping surface 6) and exerts an upward and/or rotary force thereon. Such force causes the above described relative displacement, where the gripping surface 6 of any bottle on which the closure is applied. However, the way in which the invention has been described shall not be intended to limit its operation and implementation in any manner.

It will be appreciated that the closure 1 of the present invention fulfills the intended purposes. Also, the present closure combines the advantages of simple and low-cost fabrication with strength and simplicity of use and handling.

It shall be noted that the claims shall not cover what was known before the priority and/or filing dates (which is meant as specifically disclaimed).

Those skilled in the art will obviously appreciate that a number of changes and variants may be made to the arrangements as described hereinbefore to meet incidental and specific needs.

For example, unless otherwise imposed by evident technical limitations, any feature described in a preferred embodiment may be clearly used in another embodiment, with appropriate adaptations.

Likewise, the continuity of the closure components may be broken in any manner, provided that no functional alteration to the relevant component is caused thereby.

Also, slight tapers may be imparted to the portions described above as having a cylindrical shape, in response to technological requirements.

It will be appreciated by the skilled person that the tamper evident effect does not require the central portion to be perfectly locked after first opening, but any motion (e.g. caused by clearance) tending to move the closure 1 back into the initial configuration will be acceptable, as long as the closure 1 remains in a configuration other than the initial configuration.

Therefore, the teachings of the present description and claims may be also interpreted in view of this consideration.

All the changes will fall within the scope of the invention, as defined in the following claims.

The invention claimed is:

1. A tamper evident closure for closing a mouth of a container, said tamper evident closure extending along a longitudinal axis and comprising:

an outer member comprising a top surface and an inner member comprising a top surface, each of which are movable relative to each other between:

a first configuration, corresponding to a configuration prior to first opening of the container, and a second configuration, corresponding to a configuration after first opening of the container wherein said inner member is lower relative to said outer member so that said top surface of said inner member is lower relative to said top surface of said outer member;

wherein said outer member comprises a gripping surface able to be grasped for opening and closing the tamper evident closure;

wherein said inner member comprises:

a reversible attachment portion for attaching said inner member to said container while opening and closing the container wherein said reversible attachment portion is substantially cylindrical and comprises an outer surface configured to be frictionally engaged with the container; and an irreversible attachment portion for preventing the restoration of said first configuration once the second configuration has been reached;

wherein an external appearance of said tamper evident closure in said second configuration is different from the external appearance of said tamper evident closure in said first configuration;

wherein said inner member is configured to remain axially stationary with respect to the container and said outer member is configured to move axially upwards with respect to said inner member and said container until said second configuration is reached.

2. The tamper evident closure according to claim 1, wherein said top surface of said inner member is lowered towards an interior of said tamper evident closure.

3. The tamper evident closure according to claim 1, wherein said irreversible attachment portion has a snap engagement means.

4. The tamper evident closure according to claim 3, wherein said irreversible attachment portion comprises protrusions, which may extend from an outer surface of said inner member.

5. The tamper evident closure according to claim 4, wherein said outer member includes at least two a seats formed in an inner surface of said outer member.

6. The tamper evident closure according to claim 4, comprising at least two seats formed on an inner surface of said outer member and corresponding to each protrusion of the irreversible attachment portion.

7. The tamper evident closure according to claim 6, wherein said at least two seats for each protrusion have different longitudinal and/or circumferential positions.

8. The tamper evident closure according to claim 6, wherein said at least two seats have different depths, as measured in a radial direction.

9. The tamper evident closure according to claim 1, wherein said inner member comprises a first and a second member, said gripping surface is integral with said outer member, and said outer member comprises a protrusion, wherein a projection of said protrusion on a plane perpendicular to the direction of relative motion between said outer member and said inner member overlaps a projection of both said first member and said second member on the same plane.

10. The tamper evident closure according to claim 9, wherein said protrusion comprises a lip located at an end of said protrusion opposite to the top surface of the outer member.

11. The tamper evident closure according to claim 9, wherein said protrusion comprises an abutment surface, to limit the relative axial sliding motion between said outer member and said inner member during first opening.

12. The tamper evident closure according to claim 9, wherein said protrusion comprises a prop that can prop against the inner member, said prop being hinged to said outer member at a distance from an inner edge of said top surface of the outer member, so as to deform said top surface of said outer member, thereby allowing the outer member alone to move from the second configuration to the first configuration.

13. The tamper evident closure according to claim 9, wherein when said tamper evident closure is in said second configuration, a bottom surface of said protrusion is in a seat formed in said inner member so as to create a prop engagement between said bottom surface of said protrusion and an abutment surface of said seat.

14. The tamper evident closure according to claim 13, wherein said seat is formed in said first member.

15. A tamper evident closure for closing a mouth of a container, said tamper evident closure extending along a longitudinal axis and comprising:

an outer member comprising a top surface and an inner member comprising a top surface, each of which are movable relative to each other between:

a first configuration, corresponding to a configuration prior to first opening of the container, and a second configuration, corresponding to a configuration after first opening of the container wherein said inner member is lower relative to said outer member so that said top surface of said inner member is lower relative to said top surface of said outer member;

wherein said outer member comprises a gripping surface able to be grasped for opening and closing the tamper evident closure;

wherein said inner member comprises:

a reversible attachment portion for attaching said inner member to said container while opening and closing the container wherein said reversible attachment portion comprises internal threads for engagement with external threads integrally formed on the container; and an irreversible attachment portion for preventing the restoration of said first configuration once the second configuration has been reached;

wherein an external appearance of said tamper evident closure in said second configuration is different from the external appearance of said tamper evident closure in said first configuration;

wherein said inner member is configured to remain axially stationary with respect to the container and said outer member is configured to move axially upwards with respect to said inner member and said container until said second configuration is reached.

* * * * *